US007283758B2

(12) United States Patent
Murakami

(10) Patent No.: US 7,283,758 B2
(45) Date of Patent: Oct. 16, 2007

(54) APPARATUS FOR FORMING ERASABLE AND INERASABLE IMAGES AND/OR FOR DETECTING AND ERASING ERASABLE IMAGES

(75) Inventor: Kakuji Murakami, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 302 days.

(21) Appl. No.: 10/968,045

(22) Filed: Oct. 20, 2004

(65) Prior Publication Data

US 2005/0141906 A1 Jun. 30, 2005

(30) Foreign Application Priority Data

Oct. 21, 2003 (JP) ..... 2003-360201

(51) Int. Cl.
*G03G 15/00* (2006.01)

(52) U.S. Cl. ..... 399/45; 399/82; 399/84; 399/389; 399/390

(58) Field of Classification Search ..... 399/1, 399/45, 82, 84, 389, 390
See application file for complete search history.

(56) References Cited

U.S. PATENT DOCUMENTS

| | | | | |
|---|---|---|---|---|
| 4,330,194 | A | 5/1982 | Murakami | |
| 5,607,534 | A | 3/1997 | Kawanishi et al. | |
| 5,619,765 | A | 4/1997 | Tokita et al. | |
| 5,638,842 | A | 6/1997 | Tokita et al. | |
| 5,643,380 | A | 7/1997 | Saitoh et al. | |
| 5,736,286 | A | 4/1998 | Kaneko et al. | |
| 5,769,957 | A | 6/1998 | Murakami et al. | |
| 5,782,254 | A | 7/1998 | Tanikawa et al. | |
| 5,968,301 | A | 10/1999 | Murakami et al. | |
| 2002/0071687 | A1* | 6/2002 | Matsuura et al. | 399/45 |
| 2002/0176719 | A1* | 11/2002 | Yogome et al. | |

FOREIGN PATENT DOCUMENTS

| | | |
|---|---|---|
| JP | 01-297294 | 11/1989 |
| JP | 02-55195 | 2/1990 |

(Continued)

OTHER PUBLICATIONS

U.S. Appl. No. 11/219,848, filed Sep. 7, 2005, Murakami.

(Continued)

*Primary Examiner*—David M. Gray
*Assistant Examiner*—Laura K Roth
(74) *Attorney, Agent, or Firm*—Oblon, Spivak, McClelland, Maier & Neustadt, P.C.

(57) ABSTRACT

An image forming apparatus is capable of forming an image on any of an image-erasable recording medium having recording-medium identification information and a recording medium and is capable performing image formation according to a first mode for forming an erasable image and according to a second mode for forming an inerasable image arbitrarily. The apparatus includes an image-forming unit, a detecting unit, and a control unit, feeds the image-erasable recording medium to the image-forming unit and allows the same to carry out image formation according to the first image-forming mode, when the first image-forming mode is selected, the detecting unit detects a recording medium having the recording medium-identification information, and the mode-control unit determines that image formation on an image-erasable recording medium can be carried out and does not prohibit image formation according to the first image-forming mode.

18 Claims, 6 Drawing Sheets

FOREIGN PATENT DOCUMENTS

| | | |
|---|---|---|
| JP | 04-64472 | 2/1992 |
| JP | 04-67043 | 3/1992 |
| JP | 6-83240 | 3/1994 |
| JP | 07-13383 | 1/1995 |
| JP | 07-239632 | 9/1995 |
| JP | 07-239635 | 9/1995 |
| JP | 8-30013 | 2/1996 |
| JP | 9-146427 | 6/1997 |
| JP | 09-179452 | 7/1997 |
| JP | 09-179453 | 7/1997 |
| JP | 09-204060 | 8/1997 |
| JP | 09-204061 | 8/1997 |
| JP | 10-74025 | 3/1998 |
| JP | 10-186961 | 7/1998 |
| JP | 2001-209274 | 8/2001 |
| JP | 2001-209284 | 8/2001 |
| JP | 2001-334649 | 12/2001 |
| JP | 2002-108136 | 4/2002 |
| JP | 2002-154712 | 5/2002 |

OTHER PUBLICATIONS

U.S. Appl. No. 11/363,029, filed Feb. 28, 2006, Murakami.

* cited by examiner

APPARATUS FOR FORMING ERASABLE AND INERASABLE IMAGES AND/OR FOR DETECTING AND ERASING ERASABLE IMAGES

BACKGROUND OF THE INVENTION

1. Field of the Invention

The present invention relates to an image forming apparatus such as a copying machine, printer or facsimile machine, an image erasing apparatus for erasing images formed by the image forming apparatus, and an image forming-erasing system including an image forming apparatus and an image erasing apparatus.

Specifically, it relates to, as the image forming apparatus, an electrophotographic image forming apparatus, in which an image is formed using a powdery thermoplastic image-forming material and to, as the image erasing apparatus, an image erasing apparatus, in which an image on a recording medium is erased by heating the image-forming material on the recording medium, overlaying the heated image-forming material on the recording medium with a stripping member, and separating the stripping member from the recording medium to thereby transfer the image-forming material from the recoding medium to the stripping member.

It also relates to a digital image forming apparatus such as a digital copying machine, a digital printer or a digital facsimile machine, in which an image is formed according to digital signal processing.

The present invention can be advantageously applied to an image forming process using a powdery thermoplastic image-forming material to form an image, as well as to the case where an image can be erased only according to a specific image forming process using a recording medium having specific properties. In the latter case, the present invention can serve to avoid troubles occurred when an inerasable image is formed or when an image-inerasable recording medium bearing an image is conveyed to image erasing unit.

2. Description of the Related Art

Printers, copying machines and printing machines of electrophotographic system have become wide spread and paper as a recording medium has been consumed in a large quantity. Such paper generally used as the recording medium is made from pulp derived from wood. Volume consumption of paper leads to deforestation and deteriorates the terrestrial environment. Reducing the consumption of paper has become a challenge of the society. In addition, waste disposal has limitations in its space and cost, and reducing the waste also has become a challenge for the society.

To solve these problems, information recording paper which becomes unnecessary (waste paper) is recovered, disintegrated to pulp and reused according to a conventional technique. This technique, however, consumes a large quantity of energy for transporting the waste paper and for regenerating the pulp, and the resulting recycled paper has decreased rigidity and whiteness and invites image bleed when an image is printed thereon. In addition, recording media bearing recorded information are distributed out of companies and home, inviting problems in protection of security and personal privacy.

Techniques for recording, processing, transmitting and storing images as electronic information have been developed, and images are recorded and stored on paper and transmitted in markedly reduced occasions. However, when one peruses the contents of WebPages or information stored in database on a display, the efficiency of perusal may be low or the eyes may fatigue. In such cases, an increasing demand has been made to record an image to a recording medium temporarily for perusing, where the storage of the image is not required. However, no effective system has been developed for forming an image and erasing the image to thereby regenerate and reuse recording media even in the case the image is required temporarily. In particular, a strong demand has been made to provide a system that can completely erase a formed image for protection of security and personal privacy.

Japanese Patent Application Laid-Open (JP-A) No. 01-297294 discloses a method for erasing or eliminating an image on a recording medium. This method uses an image bearing member such as a plastic, a metal, a liquid-impermeable paper or ceramic and comprises the step of heating a hot melt image on the image bearing member (recording medium) with the interposition of a hot melt stripping member to thereby transfer the image to the stripping member (ink stripping member).

JP-A No. 02-55195 discloses use of a recording medium comprising a substrate such as a polyethylene terephthalate (PET) film and a releasing material such as a silicone sealant arranged on the substrate as an erasable recording medium.

JP-A No. 04-67043 discloses an erasable paper comprising a coated paper and a film of a silicone sealant arranged on the coated paper and having a mark formed with a writing instrument or a hole for distinguishing the erasable paper from regular paper.

JP-A No. 04-64472 discloses an image erasing apparatus. This apparatus uses an erasable paper comprising paper and a film of a silicone sealant formed on the paper or comprising paper and a plastic film applied onto the paper. The apparatus is so configured as to heat an image formed on the erasable paper, and an endless belt having a hot-melt resin on its surface, to bring the image and the endless belt into contact with each other, to cool the contacted image and the endless belt, to separate the erasable paper from the endless belt to thereby transfer and peel off the image from the erasable paper to the endless belt. The publication also discloses a technique, in which a mark is imparted to the erasable paper, the erasable paper is distinguished from a regular paper by detecting the mark, and the regular paper, if used, is by-passed so as not come in contact with the endless belt having the hot-melt resin on its surface to avoid paper attachment onto the endless belt. Thus, the endless belt is prevented from losing its function as a cleaning sheet.

JP-A No. 09-179452 and No. 09-179453 disclose image forming apparatuses. The disclosed image forming apparatuses are so configured as to form an image according to a first image-forming mode and a second image-forming mode. The apparatuses forms an image using a synthetic paper which does not absorb a toner, and an alcohol-soluble image-forming material according to the first image-forming mode and forms an image using a regular paper and a regular plastic toner according to the second image-forming mode. An image formed by the image forming apparatuses is removed from a recording medium with the use of an alcohol.

JP-A No. 07-239635 discloses an image forming apparatus which is so configured as to be able to select a first image-forming mode and a second image-forming mode. According to the first image-forming mode, an image is formed under regular conditions for image formation. According to the second image-forming mode, an image is formed under such conditions that ease the formed image to be erased. In the second image-forming mode, the amount of a toner applied to a recording medium is reduced by changing, for example, the exposure or development bias voltage from the first image-forming mode. The publication also discloses that a mark is imparted to entire or part of the recording paper so as to enable a user to recognize the image printed according to the second image-forming mode when the image is formed according to the second image-forming mode.

JP-A No. 07-239632 discloses an image forming apparatus, in which a mark indicating whether or not an image-erasing operation can be carried out is imparted to part of a recording medium by an image erasing apparatus. It also discloses an image forming apparatus in which a mark for prohibiting an image-erasing operation is imparted to a recording medium so as to protect a document which should not be erased from erasing by mistake, and discloses impartment of a mark for allowing an image-erasing operation.

JP-A No. 2001-209274 discloses an image forming apparatus that can use a reusable paper. In this apparatus, a reusable paper is automatically selected typically in a test printing mode, and a regular paper other then the reusable paper is automatically selected typically in a finishing mode. In the finishing mode, the printed paper is subjected to a processing such as punching. According to this technique, there is no necessity for a user to determine whether or not a reusable paper should be used.

JP-A No. 2001-209284 discloses an image forming apparatus, in which an image is formed on a reusable paper in an area where an image is erasable, and information indicating whether or not the image is erasable is recorded thereon. The information herein includes, for example, the number of usable times of the recording medium, image occupancy and type of the toner.

JP-A No. 2001-334649 discloses an image forming apparatus which works in a first image-forming mode for forming an image on a regular recording medium and a second image-forming mode for forming an image on a reusable recording medium. In the apparatus, image formation is automatically carried out based on specific information typically on whether or not a reusable recording medium is housed in a paper feed cassette or on the type of an application to which the selection of the mode is outputted.

These conventional techniques separately and respectively disclose a technique comprising use of a reusable recording medium from which an image is easily erased and formation of an identification means on the reusable recording medium; a technique in which a mark for prohibiting or permitting image erasing is imparted to a recording medium upon image formation based on whether or not a target document should be protected from erasing; and a technique of detecting whether or not a reusable recording medium is housed in a paper feed cassette.

The systems disclosed in these conventional techniques may invite some troubles as shown below. For example, if an image is printed on a reusable paper by a printer of a system according to which the resulting image is inerasable and the resulting reusable paper carrying an inerasable image may be fed to an image erasing apparatus, thus inviting troubles. If reusable recording media are mixed with regular recording media and fed to an image erasing apparatus, they may also invite some troubles in the apparatus. These problems are typical in a specific type of image erasing apparatuses. In these image erasing apparatuses, an image-forming material is eliminated from a recoding medium to regenerate the recording medium by heating and pressurizing the recording medium and a stripping member to intimate contact, then separating the stripping member from the recording medium to thereby transfer the image-forming material from the recording medium to the stripping member. According to this system, the stripping member cannot be significantly separated from the recording medium if the recording medium is an image-inerasable recording medium or a reusable recording medium bearing an image formed from an inerasable image-forming material. This invites jamming of the recording medium in the image erasing apparatus. In addition, such conventional image forming-erasing systems are not configured integrally. More specifically, the components of the systems, such as an image forming process for easier erasing of the resulting image, a reusable recording medium and an apparatus for forming a reusable image, are not well organized. Thus, an image is not completely removed or eliminated by image erasing operation, or a recording medium after an image-erasing operation has some deteriorated properties. In other words, there is no effective system for fully erasing an image and avoiding troubles in an image erasing apparatus even in the case where there is no necessity for the image to be printed permanently. Taking transactions for meeting as an example, it is effective to print out information on paper and peruse the printed matter during meeting, but it is not preferred for attendees to store the printed matter as a paper document after the meeting, since such stored paper documents are difficult to be surveyed and occupy a large space. The information is thus preferably stored and distributed as electronic information before or after the meeting or stored as common database on the electronic information for the attendees. On perusing stored electronic information, however, it is efficient to print out the information as an image on a sheet recording medium. Such stored electronic information can be perused on a display, but perusing the information on the display is not efficient, since a plurality of pages cannot be viewed at glance, it takes a long time to reach a target page, and the entire document cannot be significantly overviewed. The information is often confidential. Thus, when an image formed on a recording medium is perused temporarily and is then erased, the image must be fully erased to avoid a residual image even if it is a thin image. Conventional image erasing apparatuses cannot fully erase an image to such a degree that the resulting image cannot be recognized at all.

Objects and Advantages

Accordingly, an object of the present invention is to solve the problems in conventional techniques. More specifically, an object of the present invention is to provide a method or device for forming an image on a recording medium in the case where a user wants to reuse the recording medium. Another object of the present invention is to provide a technique for fully erasing an image on a recording medium, which image is formed provided that the recording medium is reused, by an image-erasing device to such a degree that a residual image, if any, after image erasing cannot be recognized at all, as in the use of a shredder. Yet another object of the present invention is to avoid troubles occurred in an image erasing apparatus due to imperfect erasing (removal) of an image and is particularly to avoid troubles such as jamming of recording media in a specific type of image erasing apparatuses. In this type of image erasing apparatuses, an image-forming material is eliminated from a recoding medium to regenerate the recording medium by heating and pressurizing the recording medium and a stripping member to intimate contact, then separating the stripping member from the recording medium to thereby transfer the image-forming material from the recording medium to the stripping member. A further object of the present invention is to provide an image forming apparatus, an image erasing apparatus and an image forming-erasing system, in which an image temporarily formed on a recording medium by the image forming apparatus is fully or completely erased or eliminated to such a degree that a remained image, if any, cannot be recognized by any way such as visual observation.

SUMMARY OF THE INVENTION

Specifically, the present invention provides an image forming apparatus capable of forming an image on any of an image-erasable recording medium and a recording medium other than the image-erasable recording medium, the image-erasable recording medium being so configured that an image formed on the recording medium can be erased and having recording-medium identification information for identifying the recording medium as an image-erasable recording medium. The apparatus is so configured as to select a first image-forming mode for forming an erasable image and a second image-forming mode for forming an inerasable image other than an erasable image arbitrarily. The apparatus includes an image-forming unit capable of carrying out image formation according to the first image-forming mode and image formation according to the second image-forming mode, respectively, a detecting unit for detecting the recording-medium identification information of an image-erasable recording medium (hereinafter it may be referred to as "recording-medium ID detecting unit"), and a mode-control unit (hereinafter it may be referred to as "first mode control unit") serving to determine whether or not image formation on an image-erasable recording medium can be carried out based on the detection by the detecting unit and to prohibit the image-forming unit from carrying out image formation according to the first image-forming mode even if the first image-forming mode is selected, unless the mode-control unit determines that image formation on an image-erasable recording medium can be carried out. The apparatus is so configured as to allow the image-forming unit to feed the image-erasable recording medium and to carry out image formation on the image-erasable recording medium according to the first image-forming mode, provided that the first image-forming mode is selected, that the detecting unit detects a recording medium having the recording medium-identification information for identifying the recording medium as an image-erasable recording medium, that the mode-control unit determines that image formation on an image-erasable recording medium can be carried out, and that the mode-control unit does not prohibit image formation according to the first image-forming mode.

The present invention further provides an image erasing apparatus including an image erasing unit for erasing an image on a recording medium, a detecting unit for detecting mode-identification information (hereinafter it may be referred to as "mode ID detecting unit"), the mode-identification information being formed on a recording medium by the action of an image forming apparatus and identifying an image as being formed according to a first image-forming mode for forming an erasable image, and a control unit being so configured as to prohibit the image erasing unit from carrying out an image-erasing operation on a recording medium unless the mode-identification information is detected on the recording medium.

The present invention further provides a reusable, image-erasable recording medium in the form of a rectangular sheet, having a notch or hole at the center part along the side edge, a notch or hole at the center part along the long side edge, two notches or holes at the parts in the vicinity of the two corners, or three notches or holes at the parts in the vicinity of the three corners.

In addition and advantageously, the present invention provides an image forming-erasing system including an image forming apparatus and an image erasing apparatus, in which the image forming apparatus is so configured as to be able to form an image both on an image-erasable recording medium and a recording medium other than the image-erasable recording medium, the image-erasable recording medium being so configured that an image formed on the recording medium can be erased and having recording-medium identification information for identifying the recording medium as an image-erasable recording medium, and the image forming apparatus is so configured as to select a first image-forming mode for forming an erasable image and a second image-forming mode for forming an inerasable image other than the erasable image arbitrarily. The image forming apparatus herein includes an image-forming unit capable of carrying out image formation according to the first image-forming mode and image formation according to the second image-forming mode, respectively, a detecting unit for detecting the recording-medium identification information of the image-erasable recording medium (hereinafter it may be referred to as "recording-medium ID detecting unit"), a mode-control unit (hereinafter it may be referred to as "first-mode control unit") serving to determine whether or not image formation on an image-erasable recording medium can be carried out based on the detection by the detecting unit and to prohibit the image-forming unit from carrying out image formation according to the first image-forming mode, even when the first image-forming mode is selected, unless the mode-control unit determines that image formation on an image-erasable recording medium can be carried out. Moreover, the image forming apparatus is so configured as to impart mode-identification information to an image-erasable recording medium, the mode-identification information identifying an image as being formed according to the first image-forming mode. The image erasing apparatus in the system includes an image erasing unit for erasing an image formed by the image forming apparatus, a mode-identification information detecting unit for detecting the mode-identification information (hereinafter it may be referred to as "mode ID detecting unit"); and a control unit. The control unit of the image erasing apparatus is so configured as to prohibit the image erasing unit from carrying out an image erasing operation on a recording medium unless the mode-identification information is detected on the recording medium. In addition, the control unit of the image erasing apparatus is so configured as to allow the image erasing unit to carry out an image erasing operation to thereby erase the image and the mode-identification information on the recording medium when the mode-identification information is detected on the recording medium.

DESCRIPTION OF THE PREFERRED EMBODIMENTS

Figure 1:
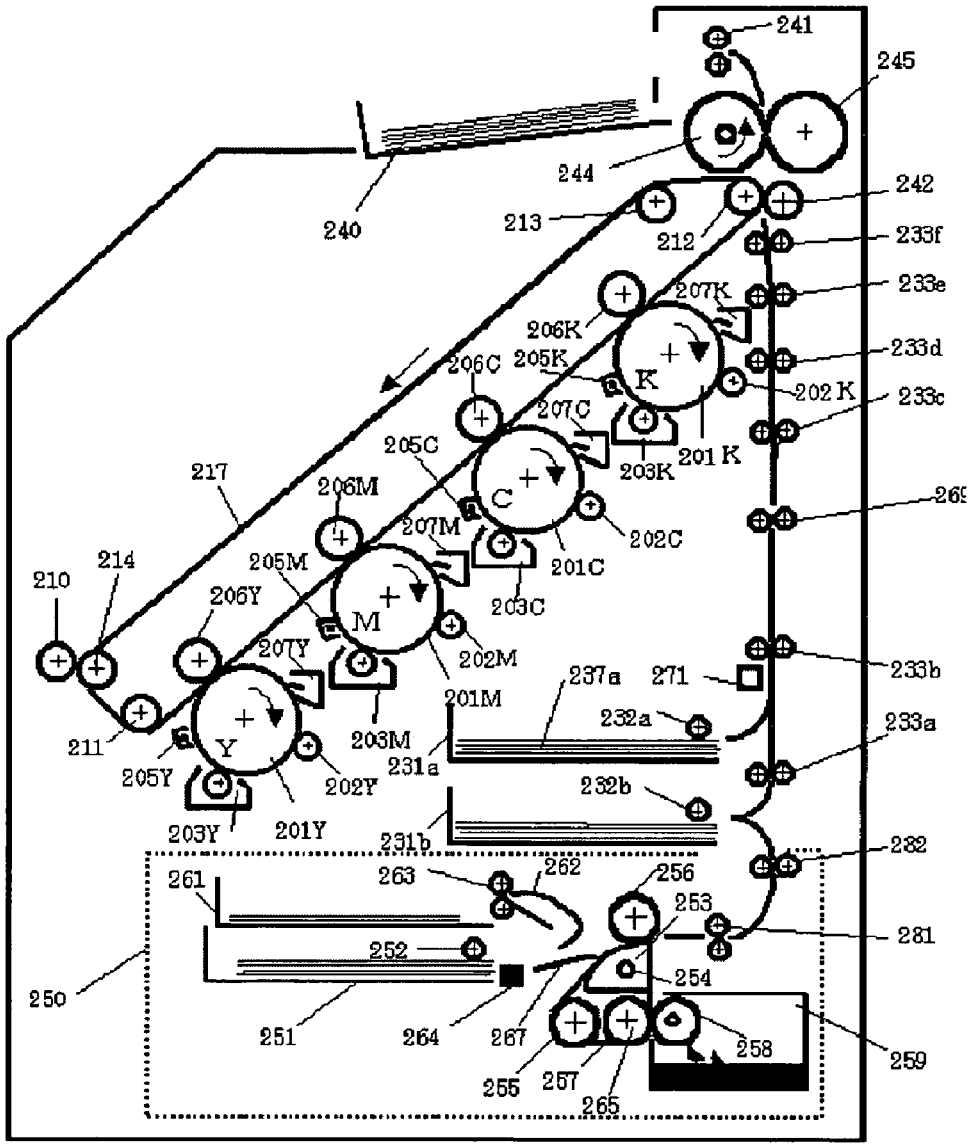
FIG. 1 illustrates an example of an image forming-erasing system according to the present invention, in which an image forming apparatus for electrophotographically forming an image, and an image erasing apparatus are housed in one casing.

The method for forming/erasing an image, the image forming apparatus, the image erasing apparatus and the image forming-erasing system according to the present invention will be illustrated in detail below.

The image forming apparatus in the first aspect of the present invention has the following configuration. The image forming apparatus is capable of forming an image on any of an image-erasable recording medium and a regular recording medium other than the image-erasable recording medium. The image-erasable recording medium is so configured that an image formed on the recording medium can be erased and has recording-medium identification information for identifying the recording medium as an image-erasable recording medium. The apparatus is so configured as to select a first image-forming mode for forming an erasable image and a second image-forming mode for forming an inerasable image arbitrarily. The apparatus includes an image-forming unit capable of carrying out image formation according to the first image-forming mode and image formation according to the second image-forming mode, respectively, a detecting unit for detecting the recording-medium identification information of an image-erasable recording medium (recording-medium ID detecting unit), and a mode-control unit (first-mode control unit) serving to determine whether or not image formation on an image-erasable recording medium can be carried out based on the detection by the recording-medium ID detecting unit and to prohibit the image-forming unit from carrying out image formation according to the first image-forming mode even if the first image-forming mode is selected, unless the mode-control unit determines that image formation on an image-erasable recording medium can be carried out. The apparatus is so configured as to allow the image-forming unit to feed the image-erasable recording medium and to carry out image formation on the image-erasable recording medium according to the first image-forming mode, provided that the first image-forming mode is selected, that the detecting unit detects a recording medium having the recording medium-identification information for identifying the recording medium as an image-erasable recording medium, that the mode-control unit determines that image formation on an image-erasable recording medium can be carried out, and that the mode-control unit does not prohibit image formation according to the first image-forming mode.

Known image-erasable recording media can be used herein. Examples thereof are films coated with a releasing agent as disclosed in above-mentioned JP-A No. 02-55195 and JP-A No. 04-67043. Concrete examples of such image-erasable recording media are paper applied with a surfactant or a silicone compound typically including a silane coupling agent or a silicone resin, as well as a paper having an improved wet strength formed by adding a trace amount of a polymer to a paper after paper making.

Examples of a recording medium comprising a paper applied with a surfactant are those disclosed in JP-A No. 10-74025. Examples of the surfactant for use herein are fluorine-containing surfactants, silicone-containing surfactants, and surfactants each containing a linear or branched alkyl group having eight or more carbon atoms per molecule. The fluorine-containing surfactants include, for example, anionic surfactants such as salts of fluoroalkyl carboxylic acids and salts of fluoroalkylsulfonic acids; amphoteric surfactants such as fluoroalkyl-induced betaine; nonionic surfactants; and cationic surfactants. The silicone-containing surfactants include, for example, epoxy-modified, alkyl-modified, aralkyl-modified, amino-modified, carboxyl-modified, alcohol-modified, fluorine-modified, and polyether-modified silicone oils. The surfactants each containing a linear or branched alkyl group having eight or more carbon atoms per molecule include, for example, anionic surfactants such as salts of carboxylic acids, salts of sulfuric esters, salts of sulfonic acid, salts of phosphoric esters; cationic surfactants such as amine salts, amine derivatives, quaternary ammonium salts, imidazoline, and imidazolinium salts; and amphoteric surfactants such as betaine. Each of these surfactants serves to decrease adhesion force between the recording medium such as paper and the image-forming material by applying to the surface of the recording medium.

Examples of recording media applied with a silicon compound are disclosed typically in JP-A No. 09-204060 and JP-A No. 09-204061. The recording media for use herein may be selected from among commercially available paper products, as long as an image forming material can be easily removed therefrom, since they have high smoothness and/or rigidity, or they have low adhesion between the material forming the surface of the recording media with the image-forming material.

The information for identifying the recording medium as an image-erasable recording medium (recording medium-identification information) may be imparted according to a conventional procedure. Namely, the recording medium-identification information can be imparted by forming a notch or a hole formed in part of a sheet-like recording medium, by coloring part or whole of the recording medium with a distinguishable colorant such as a dye or pigment, by printing, on the recording medium, a bar code that can be read by the image forming apparatus, or by printing a mark other than bar code on the recording medium. The colorant for use herein can be any of a visible-ray absorbing colorant, an ultraviolet or infrared absorbing colorant, a fluorescence-emitting colorant and a magnetic ink, as long as it is distinguishable. The recording medium-identification information can be in the form of an IC chip that responds to electromagnetic waves. Among these forms of the recording medium-identification information, a notch and/or a hole is typically preferred. Since the recording medium-identification information formed in the form of a notch or hole does not disappear when an image formed thereon is used or the image is erased. The notch or hole can be easily distinguished by the image forming apparatus or user when plural sheets of the recording medium are stacked in a recording medium housing unit of the image forming apparatus. In addition, the notch or hole can be formed at relatively low cost.

Examples of the recording-medium ID detecting unit are transmissive or reflective optical sensors comprising a light-emitting device such as an LED in combination with a light-receiving device such as a photodiode, one-to-one sensors, CCD, spectrometers, transceivers for electromagnetic waves, mechanical displacement sensors, and magnetic sensors. The detecting unit must not only detect the contrast (light and dark) but also analyze its pattern when a bar code or mark is used as the recording medium-identification information. Most preferably, a notch and/or hole is formed on an image-erasable recording medium as the recording medium-identification information, and a detecting unit comprising a light-emitting device and a light-receiving device is used as the recording-medium ID detecting unit. This configuration can be constituted at low cost and can detect the information without errors.

The above-mentioned image forming apparatus in the first aspect of the present invention is so configured that a user can select the first image-forming mode for forming an erasable image directly in the image forming apparatus or via a user interface unit of a computer connected to the image forming apparatus a network such as LAN, in the case where the image information formed on the recording medium is utilized in a short period of time and the formed image will be erased. The image forming apparatus has a first-mode control unit. The first-mode control unit serves to prohibit image formation according to the first image-forming mode even when the first image-forming mode is selected, unless the detecting unit detects the recording medium-identification information and thereby detects an image-erasable recording medium is housed in a recording medium housing unit or a paper feed bath, and the first-mode control unit determines that image formation on an image-erasable recording medium can be carried out. The image forming apparatus is so configured as to feed an image-erasable recording medium to the image forming unit in the case where the first image-forming mode is selected and the control unit determines that image formation on an image-erasable recording medium can be carried out. The image forming apparatus preferably further comprises a display for notifying that an image cannot be formed on an image-erasable recording medium to the user in the case where the first image-forming mode is selected but the first-mode control unit does not determine that image formation on an image-erasable recording medium can be carried out. As a result of the notification, the user will take measures such as supplement of an image-erasable recording medium or selection of the second image-forming mode for forming an inerasable image.

The present invention is typically effectively applied to image forming methods using a thermoplastic image-forming material. Examples of such methods are regular electrophotography using a powdery toner or liquid toner as a photoconductor, a toner jet process in which the flight of a powdery toner is controlled by electrodes, electrostatic recording, electrostatic recording according to an ion-current-control process, magnetic recording, thermal transfer using a hot-melt ink sheet, and an ink jet process using a hot-melt ink. The image forming material constituting an image formed by any of these image forming methods can be eliminated by a method (mentioned later) comprising the steps of heating and pressurizing the recording medium and a stripping member to intimate contact, then detaching the stripping member from the recording medium to thereby transfer the image-forming material from the recording medium to the stripping member. The image forming apparatus can be any of copying machines, printers, facsimile machines and printing machines or any combination of these apparatuses.

The image forming apparatus of the present invention preferably further comprises, in a second aspect, an information-control unit. The image forming apparatus optionally comprises means for imparting information which serves to impart the mode-identification information for identifying an image as being formed according to the first image-forming mode to an image-erasable recording medium. The information-control unit serves to allow the image forming apparatus or the means for imparting information to impart the mode-identification information to at least part of a recording medium only when the first image-forming mode is selected and an image is formed on the recoding medium.

An important feature of this configuration is that the mode-identification information is imparted to a recording medium in the case where an image is formed according to the first image-forming mode, even if the recording medium used is an image-erasable recording medium having the recording medium-identification information as described in the first aspect. The mode-identification information preferably includes model information in addition to information indicating that the image is formed according to the first image-forming mode. According to this configuration, information indicating that the image is formed according to the first image-forming mode of a specific model of image forming apparatus is further imparted to the recording medium, even though image formation on a recording medium other than an image-erasable recording medium is prohibited according to the first image-forming mode. This is because an image may possibly formed on an image-erasable recording medium by an image forming method according which the resulting image cannot be eliminated, or by using an image forming apparatus in which the resulting image cannot be eliminated. If an image formed by an image forming apparatus on a specific recording medium having the recording medium-identification information can be eliminated, an image formed by another image forming apparatus is not always erasable. When an image is formed on the recording medium by an ink jet printer using a regular ink, the resulting image cannot be eliminated by the transfer method to a stripping member, since the regular ink is not thermoplastic. When an image forming apparatus, for example, Model A, employs a specific way or process for forming an image according to the first image-forming mode for easier elimination of the resulting image, such as a process of weakening the image-fixing properties of the image or of using an easily erasable image-forming material, an image formed according to a method other than the first image-forming mode of Model A cannot be fully eliminated by the image-erasing unit in many cases. When an image is formed by the image forming apparatus of the above-mentioned configuration, the resulting recording medium carrying an image has the mode-identification information indicating that the image is formed according to the first image-forming mode of a specific image forming apparatus. The image-erasing unit for erasing the image comprises a unit for detecting not the recording medium-identification information but the mode-identification information indicating that the image is formed according to the first image-forming mode of a specific image forming apparatus. The image-erasing unit carries out an image erasing operation only in the case where the mode-identification information is detected. This allows only a recording medium from which an image can be erased to be subjected to an image erasing operation.

The mode-identification information is unnecessary after image erasing by an image erasing apparatus and is preferably formed so as to be removable by the image forming apparatus or the image erasing apparatus. A possible solution to this is a system in which a rewritable microchip is embedded in an image-erasable recording medium, the mode-identification information is written in the microchip by an image forming apparatus, and the mode-identification information is erased and rewritten by the image forming apparatus when the recording medium is reused after the image on the recording medium is erased.

This system, however, invites a relatively expensive recording medium and requires an extra device for erasing and writing the mode-identification information. Accordingly, the mode-identification information is preferably formed and marked as an image and is erased together with other images by the image erasing apparatus.

The mode-identification information described in the second aspect is preferably, in a third aspect of the present invention, an imagewise mark formed on part of the recording medium with the use of the same image-forming material as in images other than the image formed as the mode-identification information.

As is described above, the mode-identification information is preferably formed so as to be erasable together with other images upon erasing by the image erasing apparatus. Accordingly, an imagewise mark (the mode-identification information realized as a mark) and images other than the mode-identification information are preferably formed by similar image forming methods using the same image-forming material. If an imagewise mark as the mode-identification information, for example, is formed by an ink jet recording method using a dye ink, and a regular image is formed by electrophotography in an image forming apparatus, the regular image formed by electrophotography and the imagewise mark formed from the ink cannot be erased at once in one image erasing apparatus. If a mark as the mode-identification information remains on a recording medium after image erasing, the image erasing apparatus may determine that an image is formed according to the first image-forming mode of an image-erasable image forming apparatus even when the image is formed according to a method in which the resulting image cannot be erased, thus inviting troubles in the image erasing apparatus.

The image forming apparatus of the present invention, in a fourth aspect, may further comprise one or more housing units capable of housing both the image-erasable recording medium and a regular recording medium other than the image-erasable recording medium, respectively. In this apparatus, the recording-medium ID detecting unit is arranged in the housing unit as a detecting unit for detecting whether or not a recording medium housed in the housing unit is the image-erasable recording medium, and the first-mode control unit determines that image formation on an image-erasable recording medium can be carried out, provided that the first image-forming mode is selected and that the detecting unit detects the image-erasable recording medium being housed in the housing unit.

It is possible that the recording-medium ID detecting unit is arranged in a convey path downstream from a paper feed unit of the image forming apparatus and determines whether or not a fed recording medium is an image-erasable recording medium. This configuration, however, requires extra procedures typically for turning the conveying direction of the recording medium and returning the same to a storage casing, or for conveying the recording medium to an output tray without image formation in the case where the conveyed recording medium has no mode-identification information even through the first image-forming mode is selected. This is because whether or not the recording medium is an image-erasable recording medium is determined only after the recording medium is fed to the convey path. In addition, it takes a long time for the user to become aware that an image cannot be formed according to the first image-forming mode under this condition. Accordingly, the recording-medium ID detecting unit is preferably arranged in the recording medium storage casing and detects whether or not a recording medium housed in the storage casing is an image-erasable recording medium. This allows the image forming apparatus to decide whether or not the image-erasable recording medium is fed to the image-forming unit at the same time or immediately after the first image-forming mode is selected. The image forming apparatus is more preferably so configured as to make a display for notifying, to the user, that no image-erasable recording medium is housed in the storage casing in the case where no image-erasable recording medium is detected in the housing unit (storage casing). This enables the user to take a measure, such as supplying an image-erasable recording medium to the storage casing or forming an image according to the second image-forming mode, easily.

The image forming apparatus of the present invention may further comprise, in a fifth aspect of the present invention, a second-mode control unit being so configured as to prohibit image formation on the image-erasable recording medium when the second image-forming mode is selected.

The user may select the second image-forming mode, for example, in the cases where the resulting recording medium is distributed typically to customers out of the company, department or family to which the user belongs; information to be recorded as an image must be protected from tampering, for example in a contract, legally predicted application document or report; and the resulting recording medium bearing an image is stored as a paper document over a long period. The image-erasable recording medium is not suitable in these applications. If a document printed on a recording medium having the recording medium-identification information as a notch and/or hole or a printed bar code is distributed, the document appears bad and has an unnecessary information, the recording medium-identification information, thus inviting troubles. The document printed on the image-erasable recording medium may be tampered after distribution to a third party, because the image formed on the image-erasable recording medium can be easily erased. In addition, such an image-erasable recording medium is relatively expensive more than a regular recording medium, and is not preferably distributed to a third party or stored over a long period from the viewpoint of economical efficiency. Accordingly, the second image-forming mode-control unit prohibits the image-forming unit from image formation on the image-erasable recording medium in the case where the second image-forming mode is selected, even when the detecting unit detects that a recording medium having recording medium-identification information is housed in the recording medium housing unit. This prevents fraudulent tampering, since the resulting image formed according to the second image-forming mode cannot be erased. For avoiding fraudulent tampering, an image is preferably formed on a regular recording medium according to the second image-forming mode, for example, by selecting an image-forming material whose image cannot be eliminated by an image-erasing unit and/or by setting the image-fixing condition so that the image-forming material is fixed to a recording medium more firmly than in the first image-forming mode. For completely avoiding fraudulent tampering, the process condition in the image erasing apparatus is preferably set so that an image can be erased only in image formation according to the first image-forming mode.

The image forming apparatus of the present invention may be so configured, in a sixth aspect, as to control the image forming apparatus not to impart the mode-identification information to a recording medium upon image formation according to the second image-forming mode.

As is described above, the user may select the second image-forming mode, for example, in the cases where the resulting recording medium is distributed typically to customers out of the company, department or family to which the user belongs; information to be recorded as an image must be protected from tampering, for example in a contract, legally predicted application document or report; and the resulting recording medium bearing an image is stored as a paper document over a long period. Extra information other than a target information may invite some troubles in these applications. Such troubles can be avoided by avoiding formation of such unnecessary information including mode-identification information on the recording medium in the second image-forming mode.

The image forming apparatus of the present invention may comprise, in a seventh aspect, one or more housing units capable of housing both the image-erasable recording medium and a regular recording medium other than the image-erasable recording medium, in which the recording medium-identification information for identifying a recording medium as an image-erasable recording medium comprises at least one of notches and holes formed on the recording medium, and wherein the recording-medium ID detecting unit is arranged in at least part of the housing unit and is so configured as to detect whether or not all the recording media housed in the housing unit each have at least one of notches and holes.

As is described above, the recording medium-identification information preferably comprises at least one of notches and holes formed on the recording medium, and the image forming apparatus preferably comprises the recording-medium ID detecting unit arranged in the housing unit. If the recording-medium ID detecting unit in the housing unit is so configured as to detect the recording medium-identification information only on the first sheet of the fed recording medium upon printing command in the first image-forming mode, the image formation is prohibited at the time when the detecting unit does not detect the recording medium-identification information on any of the subsequent sheets of the recording medium in the case where another recording medium than an image-erasable recording medium is mixed with the image-erasable recording medium. By configuring the recording-medium ID detecting unit as to detect whether or not all the recording media housed in the housing unit have at least one of notches and holes, the user can be noticed in advance whether or not image formation can be carried out in the case the user makes printing command of plural pages or plural copies according to the first image-forming mode, thus avoiding suspension of image formation on the course of printing. When the image forming apparatus has a plurality of paper feed cassettes (recording medium storage casings), the image forming apparatus is preferably so configured as to permit image formation according to the first image-forming mode in the case where the recording-medium ID detecting unit detects that all the recording media have at least one of notches and holes in at least one of the cassettes housing recording media of a desired size. There is no need to permit image formation according to the first image-forming mode only in the case where the detecting unit detects that all the recording media have at least one of notches and holes in all the cassettes.

The image forming apparatus of the present invention may be so configured, in an eighth aspect, as to fix an image-forming material onto a recording medium according to one of thermal image-fixing and flash fixing, in which the image forming apparatus further comprises a process-control unit for setting an image fixing process so adhesion of the fixed image to the recording medium is weaker in the first image-forming mode than in the second image forming mode by the action of at least one selected from the group consisting of a lower image-fixing temperature, a lower image-fixing pressure, a smaller quantity of light, a shorter image-fixing process pass and a higher image-fixing speed.

In conventional image forming apparatuses, image-fixing conditions are set so as to allow use of a wide variety of recording media, since a recording medium to be used is not specified. Namely, the image-fixing conditions are set so that a sufficient image-fixing force can be applied even to a thick paper or paper having insufficient adhesion. In contrast, an image is always formed in an image-erasable recording medium in image formation according to the first image-forming mode in the image forming apparatus of the present invention. The image-erasable recording medium is a specific recording medium and exhibits less variation of adhesion with a varying thickness or varying type of an image-forming material formed on the surface of the recording medium. The image-fixing conditions can be set within minimal ranges for the specific image-erasable recording medium so as to remove or erase the resulting image surely. Specifically, when an image is formed according to the first image-forming mode in such an image forming apparatus which is so configured as to fix an image-forming material to a recording medium by thermal image-fixing or flash fixing, there is no need to ensure image-fixing properties with respect to a variety of recording media. Thus, the resulting image can be erased or eliminated more surely by changing image-fixing conditions, for example, to a lower image-fixing temperature, a lower image-fixing pressure, a smaller exposure of flash applied for the image-fixing, a higher image-fixing speed for a shorter nip time of hot-pressing of an image-fixing roller, or a shorter image-fixing process pass. Each of these changes in image-fixing conditions can be carried out alone or in combination.

The image forming apparatus of the present invention is preferably, in a ninth aspect, so configured as to be able to form an image on both sides of a recording medium and further comprises a mode-control unit for prohibiting image formation on both sides when the first image-forming mode is selected (hereinafter it may be referred to as "duplex print mode control unit).

The image forming apparatus is preferably so configured as to form images on both sides of a recording medium in image formation according to the second image-forming mode, for reducing the amount of the recording medium to be used. This can also reduce the thickness of a file and a space for storage when printed documents on sheets of the recording medium are stored for a long time. Thus, such image forming apparatuses that can perform duplex image formation are often employed as copying machines and printers.

Prohibition of duplex image formation in the first image-forming mode is set for the following reasons.

The first image-forming mode is selected provided that an image on a recording medium is erased and the recording medium is reused. If images are formed on both sides of the recording medium, the image erasing apparatus may have a complicated configuration or requires a long time to carry out an image erasing operation. Specifically, the image erasing apparatus must further comprise a unit for detecting whether or not images are formed on both sides of the recording medium. In addition, the image erasing apparatus must further comprise extra mechanisms for reversing the recording medium after erasing of an image on one side and conveying the reversed recording medium to the image-erasing unit again, or must have plural image erasing units for erasing images on both sides separately when images are formed on the both sides of the recording medium. Duplex image formation in the first image-forming mode may invite further problems in the image erasing method comprising the steps of heating and pressurizing the recording medium and a stripping member to intimate contact, then detaching the stripping member from the recording medium to thereby transfer the image-forming material from the recording medium to the stripping member. In this method, a thermoplastic image-forming material constituting an image is heated in erasing operation of an image on one side of the recording medium. Another image-forming material constituting an image on the other side is also heated and softened and is easily attached to constitutional components of the image erasing apparatus, such as pressure rollers and convey rollers. Thus, the recording medium may be wrapped around the roller, be jammed or invite deposition of the image-forming material on the components, which invites offset of the deposition to a successive recording medium to be treated. To avoid adhesion of the image-forming material and to prevent these troubles, the constitutional components of the image erasing apparatus must be treated with, for example, a fluorocarbon resin. The resulting image erasing apparatus has a complicated configuration and/or is expensive.

By arranging the duplex print mode control unit, the image erasing apparatus can have a simple configuration and is available at low cost, since the image erasing unit has only to treat only one side of the recording medium, and there is no need for the image erasing apparatus to comprise extra devices or mechanisms. Examples of such extra devices and mechanisms are a complicated convey path, means for detecting whether or not images are formed on both sides of the recording medium, a container for storing a recording medium whose image on one side has been erased, and treated constitutional components to avoid attachment of the image-forming material. In addition, the mechanism for reversing the recording medium is not required, and the image erasing apparatus can perform an image-erasing operation at higher speed, thus reducing jamming of the recording medium in the image erasing apparatus.

The image forming apparatus of the present invention, in a tenth aspect, is preferably is so configured as to form an image onto a recording medium both according to a binary image-forming mode and a multi-level image-forming mode, respectively, and further comprises a mode-control unit for prohibiting the multi-level image-forming mode and allowing image formation according to the binary image-forming mode when the first image-forming mode is selected (hereinafter it may be referred to as "digital recording mode control unit").

Image forming (recording) methods by digital processing are classified as a binary recording method and a multi-level recording method. In the binary recording method, a halftone image is recorded by varying the number of dots per unit area with a constant image density of dots. In the multi-level recording method, a halftone image is recorded with a varying image density at two or more levels. The resulting halftone image formed by the multi-level recording method may be free from graininess in theory. However, such a halftone image formed by the multi-level recording method may invite some troubles in the image erasing method comprising the steps of heating and pressurizing the recording medium and a stripping member to intimate contact, then detaching the stripping member from the recording medium to thereby transfer the image-forming material from the recording medium to the stripping member to thereby eliminate the image-forming material. Specifically, if an image formed on the recording medium has a small thickness, the image-forming material on the recording medium is difficult to be in contact with the stripping member, and the image may not be fully removed. Thus, prohibiting image formation by the multi-level mode and carrying out halftone image formation by the binary mode in the first image-forming mode for forming an erasable image, the resulting halftone image formed on the recording medium has a thickness at a specific level or more and can be in contact with the stripping member. This avoids failures in image erasing.

In the image forming apparatus of the present invention, the configurations of the first-mode control unit, second-mode control unit, information control unit, duplex print mode control unit and digital recording mode control unit are not particularly limited and these units may selectively consists one or more parts in combination.

The image erasing apparatus in an eleventh aspect of the present invention comprises an image erasing unit for erasing an image on a recording medium, a detecting unit for detecting mode-identification information (hereinafter it may be referred to as "mode ID detecting unit"), the mode-identification information being formed on a recording medium by the action of an image forming apparatus and identifying an image as being formed according to a first image-forming mode for forming an erasable image, and a control unit being so configured as to prohibit the image erasing unit from carrying out an image-erasing operation on a recording medium unless the mode-identification information is detected on the recording medium.

As is described in detail in the image forming apparatus of the second aspect of the present invention, whether or not an image formed on a recording medium can be reliably determined in the image erasing apparatus, not by detecting the recording medium-identification information for indicating as being an image-erasable recording medium but by detecting the mode-identification information for indicating an image as being formed according to the first image-forming mode of a specific image forming apparatus. This avoids troubles caused by insufficient removal of image. For example, if a recording medium from which an image is erased, and a recording medium from which an image has not been removed are mixed and subjected to another image forming operation in the image forming apparatus, an image formed on the recording medium bearing the residual image cannot be read out. This problem can be avoided by reliably feeding an image-erasable recording medium alone to the image erasing apparatus and ejecting only a recording medium from which the image has been erased as a reusable recording medium. This configuration also avoids the jamming of the recording medium caused by separation failure between the recording medium and the stripping member in the image erasing method comprising the steps of heating and pressurizing the recording medium and a stripping member to intimate contact, then detaching the stripping member from the recording medium to thereby transfer the image-forming material from the recording medium to the stripping member to thereby eliminate the image-forming material.

The image erasing apparatus comprise the mode ID detecting unit for detecting a mode-identification mark which is formed only in the case where an image is formed according to the first image-forming mode, in combination with the recording-medium ID detecting unit for detecting the recording medium-identification information for identifying as being an image-erasable recording medium. In this case, the image erasing apparatus is so configured as to carry out an image-erasing operation only in the case where the two types of information are detected.

The image erasing apparatus is preferably so configured as to convey a recording medium on which an image erasing operation is prohibited via a convey path that does not pass through the image erasing unit and to store the recording medium in a container other than one for a recording medium from which an image has been removed. Alternatively, the image erasing apparatus may be so configured as to cancel part of its functions to thereby not carry out the image erasing operation in the case where no mode-identification information is detected on the recording medium. For example, the image erasing operation can be cancelled by canceling the pressure of the pressure roller for pressurizing the recording medium and the stripping member, when the image erasing apparatus employs the image erasing method comprising the steps of heating and pressurizing the recording medium and a stripping member to intimate contact, then detaching the stripping member from the recording medium to thereby transfer the image-forming material from the recording medium to the stripping member to thereby eliminate the image-forming material.

Any known image-erasing unit can be used in the image erasing apparatus of the present invention. The image can be erased, for example, by an image erasing unit comprising a heater for heating a recording medium bearing an image and a pressurizer for pressurizing the recording medium and a stripping member having adhesion to an image-forming material constituting the image to intimate contact, and a detacher for separating the stripping member from the recording medium to thereby transfer the image-forming material from the recording medium to the stripping member to thereby eliminate the image-forming material. This method is disclosed in above-mentioned JP-A No. 04-64472.

The image-erasing unit may be utilized in an image erasing method further comprising at least one additional process before or after the aforementioned processes of heating and pressurizing a recording medium bearing an image and a stripping member having adhesion to an image-forming material constituting the image to intimate contact, then separating the stripping member from the recording medium to thereby transfer the image-forming material from the recording medium to the stripping member to thereby eliminate the image-forming material. As is disclosed in JP-A No. 07-13383, for example, the image erasing method for use herein may comprise the processes of applying a liquid typically containing water to a recording medium to thereby weaken the adhesion between the image-forming material and the recording medium, heating and pressurizing a recording medium bearing an image and a stripping member having adhesion to an image-forming material constituting the image to intimate contact, then separating the stripping member from the recording medium to thereby transfer the image-forming material from the recording medium to the stripping member to thereby eliminate the image-forming material.

The image erasing apparatus of the present invention may employ a unit for erasing an image on a recording medium by rubbing and scraping. The image-erasing unit, for example, serves to peel and eliminate an image from a recording medium by rubbing and scraping the image with a side of a roller having a spiral blade or by the use of a brush-like rubbing-scraping member. When this unit is employed, the recording medium is preferably a recording medium having a hard surface made of, for example, an ultraviolet-curable resin or thermosetting resin, or a recording medium having a surface applied with a compound serving to decrease the adhesion with the image-forming material. Thus, the resulting image can be easily eliminated. The recording medium used herein may have the recording medium-identification information indicating as being an image-erasable recording medium.

The image forming apparatus of the present invention may employ means for applying a liquid that allows the image on the recording medium to dissolve or swell to the recording medium to thereby wash out the image with the liquid. Suitable examples of the recording medium for use in the method of removing an image by washing with a liquid are a recording medium coated with a liquid-repellent compound for avoiding absorption of the liquid by the recording medium, and a recording medium which a smooth surface for avoiding permeation of the image-forming material into the recording medium and has a surface comprising a resin having a crosslinked structure for avoiding the recording medium from dissolving in the liquid. The recording medium-identification information for indicating as being an image-erasable recording medium can be imparted to such a recording medium.

The image erasing apparatus of the present invention according to the eleventh aspect is, in a twelfth aspect, that the control unit is so configured as to prohibit the image erasing unit from carrying out an image-erasing operation on a recording medium unless the mode-identification information is detected on the recording medium, even when the recording medium has the recording medium-identification information for identifying the recording medium as an image-erasable recording medium. As is described above, the image erasing apparatus preferably comprises the mode ID detecting unit in combination with the recording-medium ID detecting unit. In this case, the image erasing apparatus is so configured as to carry out an image-erasing operation only in the case where the two types of information are detected. Thus, the image erasing operation can be more surely carried out only in the case the image is erasable. Whether or not the image formed on the recording medium is erasable can be more reliably determined by prohibiting the image erasing unit from carrying out an image-erasing operation on a recording medium in the case where the mode-identification information is not detected on the recording medium even if the recording medium has information for identifying the recording medium as an image-erasable recording medium. This avoids troubles or problems due to imperfect image erasing.

The image erasing unit of the image erasing apparatus of the present invention may comprise, in a thirteenth aspect, a heater for heating an image-forming material on the recording medium, a stripping member, a pressurizer for pressing the striping member against the heated image-forming material on the recording medium, and a detacher for detaching the stripping member from the recording medium.

As is described above, mixing of a recording medium bearing an inerasable image formed typically from a thermoplastic image-forming material and the resulting jamming of the recording medium due to insufficient separation should be avoided when the image erasing apparatus erases an image by the image erasing method comprising the processes of heating and pressurizing a recording medium bearing an image and a stripping member having adhesion to an image-forming material constituting the image to intimate contact, then separating the stripping member from the recording medium to thereby transfer the image-forming material from the recording medium to the stripping member to thereby eliminate the image-forming material. Thus, the present invention is typically advantageously applied to such an image erasing apparatus, in which the image-transfer material on the recording medium is transferred to the stripping member by heating and pressurizing.

The reusable, image-erasable recording medium in a fourteenth aspect of the present invention is in the form of a rectangle and has a notch or hole at the center part along the side edge, a notch or hole at the center part along the long side edge and a notch or hole at the center part along the short side edge, two notches or holes at the parts in the vicinity of the two corners, or three notches or hole at the parts in the vicinity of the three corners.

The reusable, image-erasable recording medium is preferably treated on both sides in a similar manner and is preferably used in image forming-erasing on both sides in similar number of times. If a compound for decreasing the adhesion with the image-forming material, such as a toner-repellent agent, is applied to only one side of the recording medium, for example, the recording medium often becomes curled under varying environmental conditions or varying temperatures and humidity in the image forming apparatus. This may lead to jamming in a convey path of the image forming apparatus or to formation of wrinkles. To avoid this, the recording medium is preferably treated on both sides in a similar manner. In this case, the both sides of the recording medium are preferably subjected to use in similar numbers of times. The recording medium after repetitive reuse may be deteriorated. For example, the surface cellulose fiber is peeled off or the compound applied to the surface is peeled off. By using both sides of the recording medium in similar numbers of times, the surfaces on the both sides are deteriorated to a similar extent, and the resulting recording medium can be reused in an increased number of times.

Figure 5A:
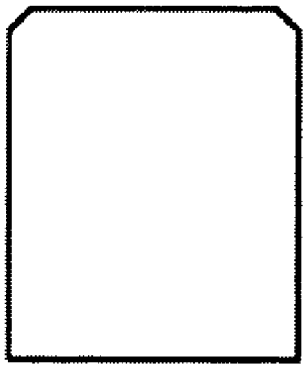
FIGS. 5A, 5B, and 5C illustrate examples of the recording media for use in the present invention.
Figure 5B:
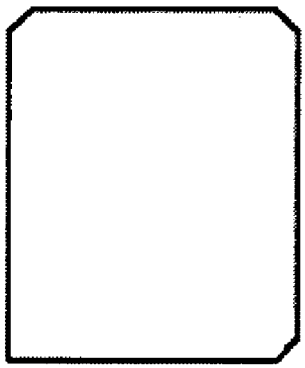
Figure 5C:
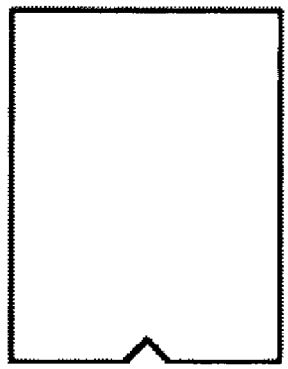
Figure 6A:
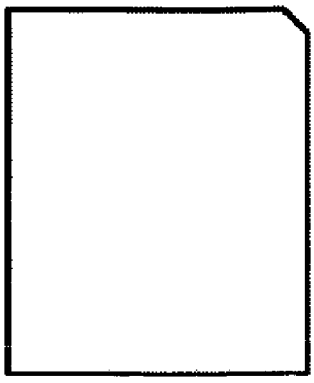
FIGS. 6A, 6B, 6C, 6D and 6E illustrate examples of the recording media for use in the present invention.

By forming at least one of notches and holes as the recording medium-identification information indicating as being an image-erasable recording medium, the presence or absence of such a notch and/or hole can be easily detected, for example, by a light-emitting device, light-receiving device or a mechanical switch, even when the recording media are stacked. In addition, the user can easily detect and remove a recording medium having neither notch nor hole, if it is mixed in a stack of recording media, by visual observation or touch. This advantage can be obtained in the case where the recording medium has only one notch or hole in one corner as shown in FIG. 6A. However, this configuration may invite a complicated structure of the recording medium housing unit or a decreased reliability of detection of the information. When sheets of such a recording medium having a notch or a hole in one corner are stacked in the housing unit and images are to be formed on both sides of the recording medium, the position of the notch or hole in the housing unit changes from one side to the other. Thus, the image erasing apparatus should have two detecting units or should be so configured as to move one detecting unit for detecting the notch or hole in the housing unit. To avoid this, the recording medium preferably has a rectangular shape and has a notch or hole at a center part along the side edge of the rectangular sheet (FIG. 5C); two notches or holes at the protions in the vicinity of two corners along one side of the rectangular sheet (FIG. 5A); or three notches or holes at parts in the vicinity of the three corners of the rectangular sheet (FIG. 5B). Thus, the recording medium-identification information can be detected by detecting a notch or hole at only one point when the recording medium is set in the housing unit any of both sides up. The recording medium storage casing can have a simplified structure.

If a recording medium having a notch or hole in the vicinity of only one corner of the rectangular sheet is subjected to image erasing in an image erasing apparatus that is so configured as to carry out an image-erasing operation on only one side of the recording medium, sheets of the recording medium must be stacked in the housing unit so that the sides of the sheets on which an image is formed face the same direction. If sheets of the recording medium bearing images on both sides are mixed with sheets bearing an image on only one side, the position of the notch or hole in sheets of the recording medium in an output tray of the image erasing apparatus after an image erasing operation varies from sheet to sheet. Such sheets of the recording medium must be aligned in the position of the notch or hole when subjected to another image forming operation in the image forming apparatus, thus markedly increasing time and efforts of the operation. This problem occurs even in the case where the image forming apparatus is capable of forming images on both sides of the recording medium by arranging a unit for detecting the presence or absence of the recording medium-identification information at two or more points of the recording medium storage casing.

When a recording medium having at least one notch or hole as the recording medium-identification information is used, the image forming apparatus preferably further comprises a control unit for permitting the apparatus to feed the recording medium in either one direction of the lengthwise direction and the cross direction of the recording medium in image formation according to the first image-forming mode, and the image erasing apparatus is preferably SO configured as to be able to convey the recording medium in only the same direction as the conveying direction in the image forming apparatus. In this case, the user can be easily set sheets of the recording medium in the housing unit of the image erasing apparatus so that the mark as the mode-identification information stands at the tip of the recording medium only by forming the mark as the mode-identification information in either one of tip and tail of the recording medium. More specifically, the user has only to set the sheets of the recording medium so that a side bearing neither notch nor hole (when notches or holes are formed in three corners, a side bearing only one notch or hole) stands at the tip or tail of the sheet in the housing unit both in the image forming apparatus and the image erasing apparatus. In this configuration, the sheets of the recording medium are housed in the housing unit of the image forming apparatus so that the sheets are fed with a side bearing neither notch nor hole (when notches or holes are formed in three corners, a side bearing only one notch or hole) standing at the tip, and a mode-identification mark as the mode-identification information is formed in the vicinity of the tip of the recording medium. The sheets of the recording medium are also set in the housing unit of the image erasing apparatus so that the sheets are fed with a side bearing neither notch nor hole (when notches or holes are formed in three corners, a side bearing only one notch or hole) standing at the tip. Thus, the sheets of the recording medium are housed so that the mode-identification mark always stands at the tip of the sheets. If sheets of the recording medium bearing the mode-identification mark standing at the tip are mixed in the housing unit, the user can be easily aware the sheets by visual observation or by touch. The sheets of the recording medium having a side bearing neither notch nor hole in the same direction are housed in the storage casing of the image erasing apparatus, are subjected to an image-erasing operation to thereby remove the image, are ejected and stacked without reversing, and can be fed and set into the storage casing of the image forming apparatus.

The image erasing apparatus is preferably so configured as to detect the mode-identification mark for indicating an image as being formed according to the first image-forming mode before or immediately after the convey of the recording medium. The resulting image erasing apparatus can have a simple configuration and a small size, since the recording medium convey path can be shortened. The sheets of the recording medium are preferably set in the storage casing of the image-erasable recording medium preferably in such a manner that the mode-identification mark stands at the tip of the recording medium for the following reasons. In the image erasing apparatus, whether or not an image erasing operation is carried out is determined by detecting the mode-identification mark for indicating an image as being formed according to the first image-forming mode. If sheets of the recording medium which have been subjected to an image erasing operation and those which have not been subjected to an image-erasing operation are mixed, the user must extract the former from the mixture to reuse the sheets in the image forming apparatus. To avoid this, the former and the latter must be conveyed in different convey paths. When the mode-identification mark stands at the tip of the recording medium fed in the image erasing apparatus, whether or not an image-erasing operation can be carried out is determined more quickly to as to determine the convey path to be fed and to determine whether or not an image-erasing operation is carried out. Thus, the convey path can be shortened and the image erasing apparatus can have a simple configuration and a small size.

The image erasing apparatus can easily detect whether or not all the recording media housed in the storage casing are image-erasable recording media by the same detecting unit as in the storage casing of the image forming apparatus.

Figure 6B:
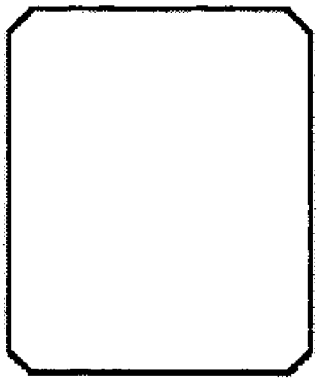
Figure 6C:
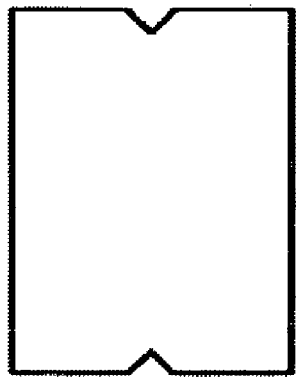
Figure 6D:
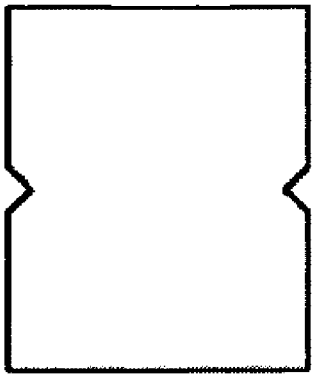
Figure 6E:
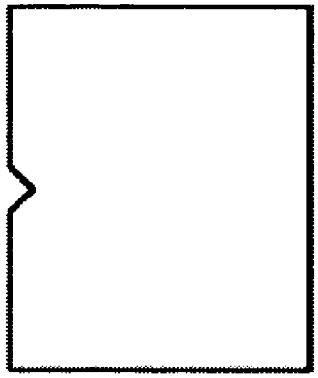

It is possible to form images on both sides of recording media having the recording medium-identification information, such as a notch or hole, at four parts in the vicinity of corners (FIG. 6B) or at two parts in center parts of sides (FIGS. 6C and 6D). These recording media, however, are not suitable in the present invention. These recording media can be set in the storage casing even in the case where the tip and the tail are reversed. Thus, the mode-identification mark must be formed both at the tip and tail of the recording media in order to detect the mode-identification mark at the tip of a conveyed sheet in the image erasing apparatus.

The image forming-erasing system in a fifteenth aspect of the present invention includes an image forming apparatus and an image erasing apparatus and is configured as follows. The image forming apparatus herein is so configured as to be able to form an image both on an image-erasable recording medium and a regular recording medium other than the image-erasable recording medium, the image-erasable recording medium being so configured that an image formed on the recording medium can be erased and having recording-medium identification information for identifying the recording medium as an image-erasable recording medium, and the image forming apparatus is so configured as to select a first image-forming mode for forming an erasable image and a second image-forming mode for forming an inerasable image arbitrarily. The image forming apparatus herein includes an image-forming unit capable of carrying out image formation according to the first image-forming mode and image formation according to the second image-forming mode, respectively, a detecting unit (recording-medium ID detecting unit) for detecting the recording-medium identification information of the image-erasable recording medium, and a mode-control unit (first-mode control unit) serving to determine whether or not image formation on an image-erasable recording medium can be carried out based on the detection by the recording-medium ID detecting unit and to prohibit the image-forming unit from carrying out image formation according to the first image-forming mode, even when the first image-forming mode is selected, unless the first-mode control unit determines that image formation on an image-erasable recording medium can be carried out, in which an information-imparting unit for imparting mode-identification information to an image-erasable recording medium,. The image forming apparatus is so configured as to impart mode-identification information to a recording medium upon image formation according to the first image-forming mode, wherein the mode-identification information identifying an image as being formed according to the first image-forming mode. The image erasing apparatus in the system includes an image erasing unit for erasing an image formed by the image forming apparatus, a detecting unit (mode ID detecting unit) for detecting the mode-identification information; and a control unit. The control unit of the image erasing apparatus is so configured as to prohibit the image erasing unit from carrying out an image erasing operation on a recording medium unless the mode-identification information is detected on the recording medium. The image forming apparatus and the image erasing apparatus in the image forming-erasing system of the present invention are preferably the image forming apparatus of the present invention and the image erasing apparatus of the present invention.

The image forming apparatus and the image erasing apparatus in the image forming-erasing system may be configured as separate bodies, be housed in one cabinet, or the image erasing apparatus is configured as a unit attachable to and detachable from the image forming apparatus. When the image erasing apparatus is configured as a unit attachable to and detachable from the image forming apparatus and is housed in the same cabinet as the image forming apparatus, the image forming apparatus and the image erasing apparatus preferably have common components such as a conveying unit, heating unit and control unit, as much as possible, for reducing the cost, weight and volume of the system.

The image forming-erasing system of the present invention is preferably configured, in a sixteen aspect, as follows. Namely, the image forming apparatus comprises the image-forming unit which is so configured as to convey a recording medium in any of a lengthwise direction (longitudinal direction) and a widthwise direction (cross direction) and to form an image on the conveyed recording medium, and a control unit for allowing the image-forming unit to convey the recording medium only in one direction selected from the lengthwise direction and the widthwise direction of the recording medium upon image formation according to the first image-forming mode. The image erasing unit of the image erasing apparatus is so configured as to be able to carry out an image-erasing operation only when the recording medium is conveyed in one predetermined direction selected from the lengthwise direction and the widthwise direction, or the image erasing apparatus comprises a control unit for allowing the image erasing unit to carry out an image erasing operation only when the recording medium is conveyed in one predetermined direction selected from the lengthwise direction and the widthwise direction.

The image forming apparatus for use herein is preferably so configured as to convey the recording medium so that the mode-identification information (imagewise mark) stands at the tip of the recording medium. The image forming apparatus is also preferably so configured as to allow the user to set sheets of the recording medium in alignment in the storage casing easily in order to avoid mixing of a regular recording medium with an image-erasable recording medium.

For this purpose, it is preferred to use the recording medium in the fourteenth aspect of the present invention and to determine the conveying direction of the recording medium in the image forming apparatus in the case of the first image-forming mode, and the conveying direction of the recording medium upon the image erasing operation in the image erasing apparatus.

For example, the image forming apparatus preferably comprises a control unit for permitting the image-forming unit to convey the recording medium only in the widthwise direction (cross direction), and the image erasing apparatus is preferably so configured as to permit the image erasing unit to carry out an image-erasing operation only in the case where the recording medium is conveyed in the lengthwise direction. In the image forming apparatus, the recording medium is conveyed in the widthwise direction to form an image thereon for image formation at high speed. In contrast, the image erasing apparatus can have reduced size and weight in the case where the recording medium is conveyed only in the lengthwise direction in the image erasing apparatus. In this case, the image-erasing operation is carried out in a shorter length (cross direction) and components constituting the image erasing unit can have a shorter length. In addition, this shorter length of the image-erasing operation reduces variation in process conditions, can use a control unit available at low cost or enables a reliable image-erasing operation. A relatively low speed of the image-erasing operation in the image erasing apparatus produces no problems in general, since the user seldom waits for the finish of the image-erasing operation.

Figure 7A:
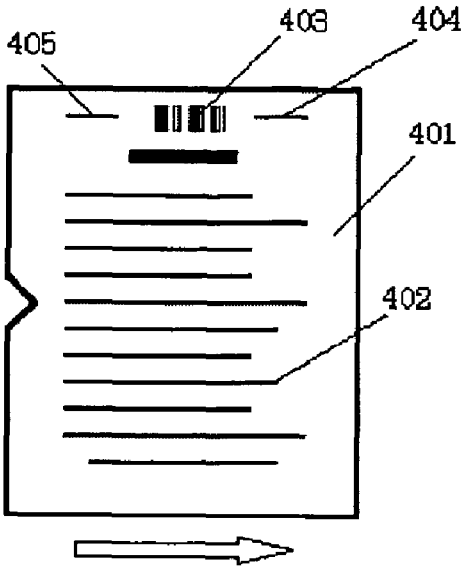
FIGS. 7A, 7B, and 7C illustrate examples of recording media on which a mode-identification mark is formed, for use in the present invention.
Figure 7B:
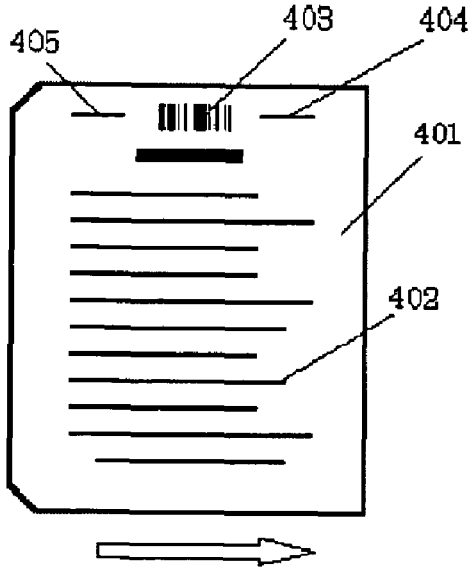
Figure 7C:
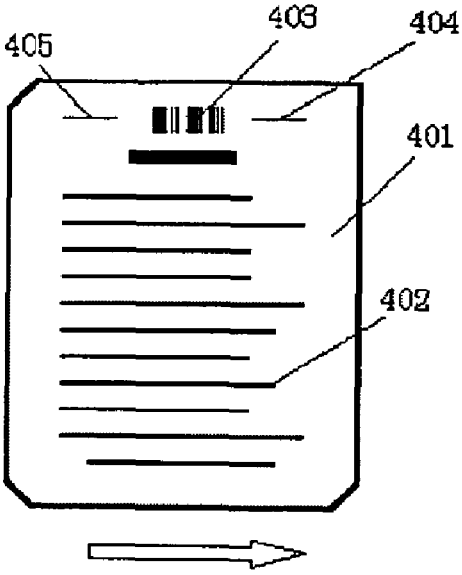

When the image forming apparatus has a control unit which allows image-forming unit to convey the recording medium only in the widthwise direction (cross direction) for image formation according to the first image-forming mode, the image-erasable recording medium in the fourteenth aspect may be used in the following manner. Specifically, when the image-erasable recording medium 401 has a notch or hole in the center part along the side edge of the rectangular sheet, the notch or hole should preferably be arranged at a center part along a long side of the rectangular sheet (FIG. 7A). When the image-erasable recording medium 401 has two notches or two holes in two corners of the rectangular sheet, the image-erasable recording medium 401 should preferably used in a manner as shown in FIG. 7B. When the image-erasable recording medium 401 has three notches or three holes in three corners, the image-erasable recording medium should preferably be used in a manner as shown in FIG. 7C. In FIGS. 7A, 7B and 7C, "402" is image information, "403" is a mode-identification mark, "404" and "405" are language massages, and the arrows show conveying direction. Thus, the recording medium-identification information can be detected by arranging a unit for detecting the notch or hole at one point of the recording medium storage casing of the image erasing apparatus, even if any one of the two sides of the recording medium is set upward in the storage casing. In contrast, when the image forming apparatus has a control unit which allows the apparatus to convey the recording medium only in the lengthwise direction, the image-erasable recording medium preferably has a notch or hole at a center part of a short side of the rectangular sheet or has notches or holes in both corners of a short side of the rectangular sheet.

The image forming apparatus in the image forming-erasing system should preferably have a control unit for forming a mode-identification mark 403 indicating that an image is formed according to the first image-forming mode in a lateral side when viewed from the conveying direction of the recording medium in the image forming apparatus, when the image forming-erasing system is so configured that the image forming apparatus has a control unit which allows the apparatus to convey the recording medium only in the widthwise direction in image formation according to the first image-forming mode, and the image erasing apparatus is so configured as to allow the image erasing unit to carry out an image-erasing operation only in the case where the recording medium is conveyed in the lengthwise direction. In this case, the control unit in the image forming apparatus controls so that the mode-identification mark 403 is formed at a predetermined side of either one of a side bearing the notch or hole or a side bearing neither notch nor hole.

As is described above, the image forming-erasing system is preferably so configured that the image forming apparatus has a control unit which allows the apparatus to convey the recording medium only in the widthwise direction in image formation according to the first image-forming mode, and the image erasing apparatus is so configured as to allow the image erasing unit to carry out an image-erasing operation only in the case where the recording medium is conveyed in the lengthwise direction. Other configurations, however, can also achieve that the recording medium is conveyed so that the mode-identification mark stands at the tip of the conveyed recording medium, and the user can easily set sheets of the recording medium in alignment in the storage casing so as to avoid mixing of the image-erasable recording medium with a regular recording medium. The speeds of both the image forming apparatus and the image erasing apparatus, for example, can be increased while achieving these objects, by conveying the recording medium in the widthwise direction both in image formation according to the first image-forming mode in the image forming apparatus and image erasing in the image erasing apparatus.

The image forming-erasing system of the present invention is preferably so configured, in a seventeenth aspect, that the image-forming unit is capable of conveying a recording medium in any of a lengthwise direction (longitudinal direction) and a widthwise direction (cross direction) and capable of forming an image on the conveyed recording medium, and that the image forming-erasing system comprising a control unit for allowing the image-forming unit to convey the recording medium only in one direction selected from the lengthwise direction and the widthwise direction upon image formation according to the first image-forming mode, and the image erasing unit of the image erasing apparatus is so configured as to be able to convey the recording medium only in the same direction as the conveying direction of the recording medium in image formation according to the first image-forming mode in the image forming apparatus, or the image erasing apparatus comprises a control unit for allowing the image erasing unit to convey the recording medium only in the same direction as the conveying direction of the recording medium in image formation according to the first image-forming mode in the image forming apparatus.

As is described in the image forming-erasing system in the sixteenth aspect, it is preferred that the recording medium in the fourteenth aspect of the present invention is used and that the conveying direction of the recording medium in the image forming apparatus upon image formation according to the first image-forming mode and the conveying direction of the recording medium in the image erasing apparatus upon image erasing operation at constant directions. This allows the recording medium to be conveyed so that the mode-identification mark stands at the tip of the conveyed recording medium and facilitates the user to align sheets of the recording medium and set in the recording medium storage casing of the image forming apparatus so as to avoid mixing of the image-erasable recording medium with a regular recording medium.

The system is typically preferably so configured that the recording medium is fed or conveyed in the same direction both in the image forming apparatus and the image erasing apparatus. In this case, the recording medium should be set in the recording medium storage casing so that the mode-identification mark, notch or hole, of the recording medium stands at the same position both in the image forming apparatus and the image erasing apparatus. This allows the recording medium to be conveyed so that the mode-identification mark stands at the tip of the conveyed recording medium and facilitates the user to align sheets of the recording medium and set in the recording medium storage casing of the image forming apparatus so as to avoid mixing of the image-erasable recording medium with a regular recording medium.

By setting the feed directions of the recording medium both in the image forming apparatus and in the image erasing apparatus at the same direction, the recording medium after image erasing operation in the image erasing apparatus can be stacked as intact as in the same direction without rotation at 90 degrees in the recording medium storage casing of the image-forming mode. In this connection, a conventional image forming-erasing system is not so configured as to read such a mode-identification information (mode-identification mark), and a recording medium can be fed in an image erasing apparatus in any of the lengthwise direction and the widthwise direction without problems even when the feed direction in the image erasing apparatus is not predetermined.

The image forming-erasing system of the present invention may be so configured, in an eighteenth aspect, that the image-forming unit is capable of conveying a recording medium in any of a lengthwise direction (longitudinal direction) and a widthwise direction (cross direction) and is capable of forming an image on the conveyed recording medium, and that the image forming-erasing system comprises a control unit for controlling the information-imparting unit to impart the mode-identification information to the recording medium when the first image-forming mode is selected and an image is formed, the portion where the mode-identification information is formed positioning at a tip or in the vicinity of the tip of the recording medium in any of the cases where the recording medium is conveyed in the lengthwise direction (longitudinal direction) and where the recording medium is conveyed in the widthwise direction (cross direction), and that the image erasing unit of the image erasing apparatus is so configured as to convey the recording medium only in one direction selected from the lengthwise direction and the widthwise direction and to carry out an image erasing operation.

Figure 8A:
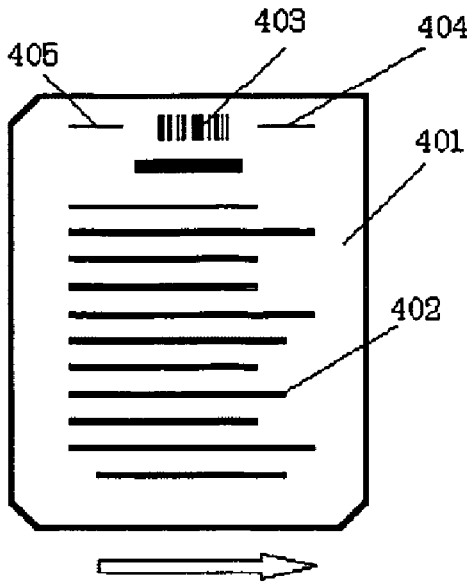
FIGS. 8A, 8B and 8C illustrate examples of recording media on which a mode-identification mark is formed, for use in the present invention.
Figure 8B:
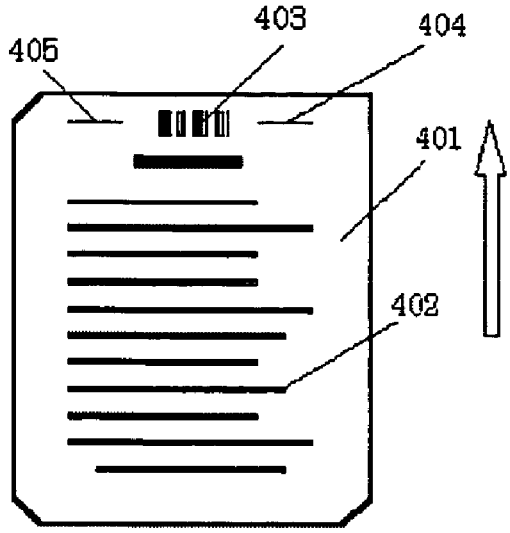
Figure 8C:
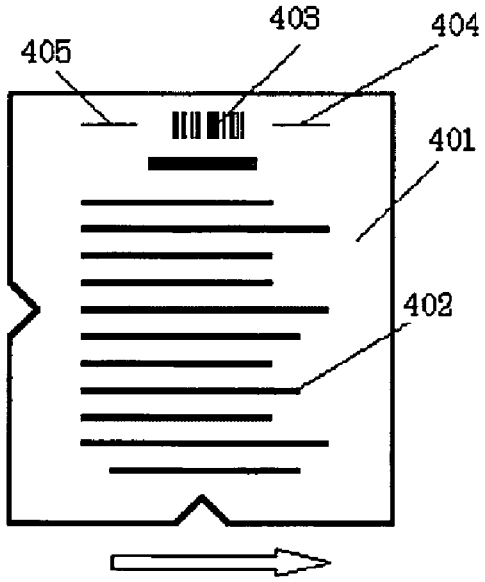

There is the case where the image forming apparatus must be so configured as to feed the recording medium in any of the lengthwise direction (longitudinal direction) and the widthwise direction (cross direction) even in image formation according to the first image-forming mode. For example, in an analog copying machine, the recording medium is preferably fed in the lengthwise direction when a A3-sized document is copied into a reduced A4-sized sheet, and the recording medium is preferably fed in the widthwise direction when a regular A4-sized document is copied. In this case, the image forming apparatus in the image forming-erasing system according to the eighteenth aspect allows the recording medium to be fed in any of the lengthwise direction (longitudinal direction) and the widthwise direction (cross direction). The image forming-erasing system is preferably so configured that the feed direction (lengthwise direction or widthwise direction) of the recording medium in the image erasing apparatus is predetermined, and that the mode-identification mark is formed on the recording medium in the image forming apparatus so that the mode-identification mark stands at the tip of the conveyed recording medium, even when the image forming apparatus allows the recording medium to be fed in any of the lengthwise direction (longitudinal direction) and the widthwise direction (cross direction) upon image formation according to the first image-forming mode. The image forming apparatus preferably has a control unit for determining the position of the mode-identification mark applied to the recording medium depending on which direction of the lengthwise direction (longitudinal direction) and the widthwise direction (cross direction) is selected as the feed direction of the recording medium. This avoids formation of a multiplicity of mode-identification marks on one recording medium. The mode-identification mark 403 should preferably be formed in a lateral side when viewed from the conveying direction in the image forming apparatus (FIG. 8A), when the conveying direction of the recording medium in the image erasing apparatus is set at the lengthwise direction and the conveying direction of the recording medium 401 in the image forming apparatus is selected at the widthwise direction (cross direction). In FIGS. 8A and 8C, the arrow indicates the conveying direction (widthwise direction) of the recording medium 401 in the image forming apparatus. In contrast, the mode-identification mark 403 is formed on a side in the conveying direction when viewed from the conveying direction in the image forming apparatus (FIG. 8B), when the conveying direction of the recording medium 401 in the image forming apparatus is selected at the lengthwise direction (longitudinal direction). In FIG. 8B, the arrow indicates the conveying direction (lengthwise direction) of the recording medium in the image forming apparatus.

When the image forming apparatus is so configured as to allow the recording medium to be fed in any of the lengthwise direction (longitudinal direction) and widthwise direction (cross direction) upon image formation according to the first image-forming mode, the image forming-erasing system is preferably configured in the following manner. Specifically, a recording medium having notches or holes in three corners (FIGS. 8A and 8B) or having notches or holes each at the center parts along a long side and a short side (FIG. 8C) is preferably used, and the image forming apparatus preferably has a control unit for determining the position of the mode-identification mark to be formed on the recording medium as constant (on a side without notch and hole, or on a side with a notch or hole). In this case, the recording medium should be set in the recording medium storage casings of the image forming apparatus and the image erasing apparatus in a predetermined direction, namely, a side bearing a notch or hole is predetermined to stand at the tip or tail of the fed sheet. This allows the recording medium to be conveyed so that the mode-identification mark stands at the tip of the conveyed sheet and allows the user to set the recording medium in the recording medium storage casing in the image forming apparatus or the image erasing apparatus so as to avoid mixing of the image-erasable recording medium with a regular recording medium, only by forming the mode-identification mark at one point in the recording medium.

The image forming-erasing system in the sixteenth aspect of the present invention is preferably so configured, in a nineteenth aspect, that the image forming apparatus comprises a control unit for allowing the image-forming unit to convey the recording medium only in a lengthwise direction of the recording medium upon image formation according to the first image-forming mode, and that the image erasing unit of the image erasing apparatus is so configured as to be able to carry out an image-erasing operation only when the recording medium is conveyed in the lengthwise direction of the recording medium, or the image erasing apparatus comprises a control unit for allowing the image erasing unit to carry out an image erasing operation only when the recording medium is conveyed in the lengthwise direction.

The image forming-erasing system in the sixteenth aspect of the present invention is more preferably so configured, in a twentieth aspect, that the information-imparting unit of the image forming apparatus is so configured as to impart an imagewise mark to the recording medium upon image formation according to the first image-forming mode, the imagewise mark serving as the mode-identification information and being formed from an image-forming material.

The image forming apparatus of the present invention comprises a control unit that allows the first image-forming mode for forming an erasable image and the second image-forming mode for forming an inerasable image other than such an erasable image to be selected arbitrarily; a detecting unit (recording-medium ID detecting unit) for detecting whether or not image formation on an image-erasable recording medium can be carried out; and a control unit (first-mode control unit) for prohibiting image formation according to the first image-forming mode even when the first image-forming mode is selected unless the detecting unit determines that image formation on an image-erasable recording medium can be carried out. This configuration controls the image-forming unit to carry out an image forming operation only on an image-erasable recording medium upon image formation according to the first image-forming mode. Thus, the resulting image formed according to the first image-forming mode can be reliably erased in the image erasing apparatus.

The image forming apparatus may be so configured as to impart a mode-identification information for indicating an image being formed according to the first image-forming mode to at least part of the recording medium upon image formation according to the first image-forming mode. By detecting the presence or absence of the mode-identification information in the image erasing apparatus, whether or not the image is an image formed on an image-erasable recording medium by image formation unit for forming an erasable image, namely, whether or not the image can be reliable erased, can be determined. This avoids troubles caused by mixing of a recording medium from which the image cannot be eliminated.

The image forming apparatus may be so configured as to form the mode-identification information as an imagewise mark from the same image-forming material as that used in formation of other images. Thus, the unit for forming the mode-identification mark can be simplified. The resulting mode-identification information formed as an imagewise mark can be erased in the image erasing apparatus. The mode-identification information can be formed at a constant position in the image forming apparatus even after repetitive reuse. This enables the image erasing apparatus to determine whether or not the recording medium bears an erasable image only by detecting the presence or absence of the mode-identification mark formed at a constant position. Both the image forming apparatus and the image erasing apparatus can have simplified configurations.

The image forming apparatus comprises the mode ID detecting unit arranged in the recording medium housing unit as a detecting unit for detecting whether or not a recording medium housed in the housing unit is an image-erasable recording medium, and the image forming apparatus may be so configured that an image forming operation is permitted only in the case where the first image-forming mode is selected, the detecting unit detects the image-erasable recording medium being housed in the housing unit and the control unit determines that image formation on an image-erasable recording medium can be carried out. Thus, information on whether or not an image can be formed according to the first image-forming mode is fed back to the user before or immediately after the user makes a printing command. Image formation can be efficiently carried out.

The image forming apparatus may be so configured as to prohibit image formation on the recording medium according to the second image-forming mode. This configuration prevents a recording medium having a notch or hole, or a recording medium bearing a mark, such as bar code, for indicating as being an image-erasable recording medium from being distributed outside and avoids the image-erasable recording medium from being tampered. In addition, it prevents such a high-cost recording medium from being distributed outside or being stored over a long time, thus increasing economical efficiency.

The image forming apparatus may be so configured as not to impart information for identifying an image as the image formed according to the second image-forming mode on the recording medium in the case where an image is formed according to the second image-forming mode. This avoids troubles caused by printing of unnecessary information.

The image forming apparatus may have the recording-medium ID detecting unit arranged in at least part of the housing unit, which detecting unit serves to detect whether or not all the recording media housed in the housing unit have at least one of notches and holes. The user can be noticed in advance whether or not image formation can be carried out in the case the user makes printing command of plural pages or plural copies according to the first image-forming mode, thus avoiding suspension of image formation in the course of printing.

The image forming apparatus may be so configured as to fix an image-forming material onto a recording medium according to one of thermal image-fixing and flash fixing, and the image forming apparatus may further comprise a process-control unit for controlling an image fixing process so as to fix an image to the recording medium more weakly according to the first image-forming mode than according to the second image forming mode by the action of at least one selected from the group consisting of a lower image-fixing temperature, a lower image-fixing pressure, a smaller quantity of light, a shorter image-fixing process pass and a higher image-fixing speed. The resulting image formed according to the first image-forming mode can be more reliably erased. This avoids troubles in the image erasing apparatus and troubles in reuse of the regenerated recording medium.

The image forming apparatus may further a mode-control unit (duplex print mode control unit) for prohibiting image formation on both sides upon in the case where the first image-forming mode is selected. The resulting image on the recording medium can be erased in an image erasing apparatus having a simple configuration for treating only one side of the recording medium and having a higher reliability.

The image forming apparatus may further comprise a control unit (digital recording mode control unit) for allowing image formation according to a binary image-forming mode and a multi-level image-forming mode, and a control unit (digital recording mode control unit) which serves to prohibit the multi-level image-forming mode and allows image formation according to the binary image-forming mode in the case when the first image-forming mode is selected. Thus, an image having good graininess can be formed according to the second image-forming mode. In addition, a binary halftone image formed according to the first image-forming mode can reduce contact failure with the stripping member and can be reliably erased in an image erasing apparatus in which the image is erased by heating and pressurizing an image-forming material and transferring the heated image-forming material to the stripping member.

The image erasing apparatus of the present invention comprises a detecting unit (mode ID detecting unit) for detecting mode-identification information, the mode-identification information being formed on a recording medium by the action of an image forming apparatus for identifying an image as being formed according to the first image-forming mode for forming an erasable image, an image erasing unit, and a control unit being so configured as to prohibit the image erasing unit from carrying out an image-erasing operation on a recording medium in the case where the mode-identification information is not detected. This apparatus avoids troubles such as paper jamming during conveying of the recording medium caused by mixing of an image-inerasable recording medium, and prevents troubles caused by mixing of a recording medium form which an image is not completely erased in reuse of a regenerated recording medium.

The image erasing apparatus may further comprise a control unit which is so configured as to prohibit the image erasing unit from carrying out an image-erasing operation on a recording medium in the case where the mode-identification information is not detected on the recording medium, even if the recording medium has recording medium-identification information for identifying the recording medium as an image-erasable recording medium. By this configuration, even if an image that cannot be erased by the action of an image forming apparatus other than a specific image forming apparatus is formed on an image-erasable recording medium, the image erasing unit is prohibited from carrying out an image-erasing operation on the recording medium. This apparatus more effectively avoids troubles such as paper jamming during conveying of the recording medium caused by mixing of an image-inerasable recording medium, and more reliably prevents troubles caused by mixing of a recording medium form which an image is not completely erased in reuse of a regenerated recording medium than in an image erasing apparatus which is so configured as to detect the recording medium-identification information alone.

The image erasing unit of the image erasing apparatus may comprise a heater for heating an image-forming material on a recording medium, a stripping member, a pressurizer for pressing the striping member against the heated image-forming material on the recording medium, and a detacher for separating the stripping member from the recording medium. If an image on an image-inerasable recording medium is erased by these units, paper jamming during conveying of the recording medium may often occur. Thus, the configuration according to the present invention for prohibiting an image-erasing operation on an image-erasable recording medium is typically advantageously applied thereto.

The reusable and image-erasable recording medium of the present invention has a rectangular shape and has a notch or hole at the center part along the side edge; a notch or hole at the center part along the long side edge and a notch or hole at the center part along the short side edge; two notches or holes at the parts in the vicinity of the two corners; or three notches or holes at the parts in the vicinity of the three corners. By using this recording medium, the recording-medium ID detecting unit arranged in the recording medium housing unit of the image forming apparatus can detect the recording medium-identification information indicating the recording medium as being an image-erasable recording medium in any case where one of the both sides of the recording medium is to be treated only by carrying out detection at one point of the recording medium storage casing. It can be easily determined whether or not the recording medium in question is turned at 180 degrees, different from recording media each having notches or holes in four corners; at two points on a diagonal; at two points at center parts of long sides; or at two points at center parts of short sides. The recording medium of the present invention can be easily set in the recording medium storage casing of the image erasing apparatus so that the mode-identification information for indicating an image as being formed according to the first image-forming mode stands at the tip in the conveying direction. The recording medium also allows the image erasing apparatus to determine whether or not all the recording media housed in the storage casing can be subjected to image erasing under the condition that sides on which images are formed are directed to the image erasing unit. In other words, if some sheets of the recording medium bear an image on one side and the other bear an image on the other side, the image erasing apparatus can detect such mixing.

In the image forming-erasing system of the present invention, the image forming apparatus has a unit for detecting and controlling so that an image is formed only on an image-erasable recording medium in the case where the first image-forming mode for forming an erasable image is selected, and the image forming apparatus forms a mode-identification mark for indicating an image as being formed according to the first image-forming mode upon image formation according to the first image-forming mode. In addition, the image erasing apparatus has a unit for detecting the presence or absence of the mode-identification mark formed in the image forming apparatus and is so configured as to prohibit an image-erasing operation in the case where no mode-identification mark is detected on the recording medium. The image can therefore be reliably erased in the image erasing apparatus, thus avoiding troubles such as jamming of the recording medium in the image erasing apparatus. The resulting recording medium from which the image has been reliably erased can be reused as intact in the image forming apparatus. The reused recording medium is free from troubles caused by a recording medium from which an image is not completely erased, such as indistinguishable image formed thereon.

The image forming-erasing system may be so configured that the feed direction of the recording medium upon image formation according to the first image-forming mode in the image forming apparatus and the feed direction of the recording medium upon image erasing in the image erasing apparatus are set at constant directions. This configuration allows the recording medium to be conveyed so that the mode-identification mark stands at the tip of the conveyed sheet and allows the user to set the recording medium in the recording medium storage casing in the image forming apparatus or the image erasing apparatus so as to avoid mixing of the image-erasable recording medium with a regular recording medium, only by using the recording medium according to the fourteenth aspect of the present invention.

The image forming-erasing system may be so configured that the recording medium is fed or conveyed in the same direction both in the image forming apparatus and the image erasing apparatus. In this case, the recording medium should be set in the recording medium storage casing so that the mode-identification information, notch or hole, of the recording medium of the present invention stands at the same position both in the image forming apparatus and the image erasing apparatus. This allows the recording medium to be conveyed so that the mode-identification mark stands at the tip of the conveyed recording medium and facilitates the user to align sheets of the recording medium and set in the recording medium storage casing of the image forming apparatus so as to avoid mixing of the image-erasable recording medium with a regular recording medium. The recording medium after image erasing in the image erasing apparatus can be ejected and stacked in the recording medium storage casing of the image forming apparatus without rotation.

The image forming-erasing system may be so configured that the conveying direction of the recording medium in the image erasing apparatus is predetermined, and that the mode-identification mark is formed on the recording medium so that the mode-identification mark stands at the tip in the conveying direction of the recording medium in the image forming apparatus when the recording medium is conveyed in any of the lengthwise direction (longitudinal direction) and the widthwise direction (cross direction) upon image formation according to the first image-forming mode. Thus, the image erasing apparatus can be simplified and reduced in size.

The image forming apparatus, the image erasing apparatus and the image forming-erasing system of the present invention will be illustrated in further detail with reference to several concrete examples below.

Examples of the image recording apparatus in the present invention are a regular electrophotographic apparatus, electrostatic recording apparatus, toner jet recording apparatus, ion flow recording apparatus and magnetic recording apparatus each using a photoconductor and a dry toner. These recording apparatuses using a dry development technique generally employ a powdery thermoplastic image-forming material mainly comprising a colorant such as a dye or pigment, and a thermoplastic resin.

Examples of the colorant for use in the image-forming material are known colorants including black pigments such as carbon black and iron oxide; yellow colorants such as C. I. Pigment Yellow 12, C. I. Pigment Yellow 13, C. I. Pigment Yellow 14, C. I. Pigment Yellow 15, C. I. Pigment Yellow 17, C. I. Pigment Yellow 93, C. I. Pigment Yellow 94, C. I. Pigment Yellow 138, C. I. Pigment Yellow 155, C. I. Pigment Yellow 156, C. I. Pigment Yellow 180 and C. I. Pigment Yellow 185; magenta colorants such as C. I. Pigment Red 2, C. I. Pigment Red 3, C. I. Pigment Red 5, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 166, C. I. Pigment Red 177, C. I. Pigment Red 178 and C. I. Pigment Red 222; and cyan colorants such as C. I. Pigment Blue 15, C. I. Pigment Blue 15:2, C. I. Pigment Blue 15:3, C. I. Pigment Blue 16 and C. I. Pigment Blue 60. The amount of the colorant is from 0.5 to 20% by weight and preferably from 1 to 10% by weight in the powdery image-forming material.

The resin component for use in the thermoplastic powdery image-forming material can be any known material for electrophotographic toner. Examples of the resin components are polyester resins; homopolymers of styrene and its substituted derivatives, such as polystyrene, poly-chlorostyrene and polyvinyltoluene; styrene copolymers such as styrene-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic ester copolymers; poly(methyl methacrylate)s, poly (butyl methacrylate)s, poly(vinyl chloride)s, poly(vinyl acetate)s, polyethylenes, polypropylenes, polyesters, epoxy resins, epoxy polyol resins, polyurethanes, polyamides, poly (vinyl butyral), poly(acrylic acid) resins, rosin, modified rosin, terpene resins, aliphatic or alicyclic hydrocarbon resins and aromatic petroleum resins. The amount of the resin component in the powdery image-forming material is from 60 to 99.5% by weight and preferably from 80 to 97% by weight.

The formed powdery image will be fixed to the recording medium using a thermal image-fixing unit. The image on the recording medium will be erased by heating and pressurizing the recording medium and a stripping member to intimate contact, then separating the stripping member from the recording medium to thereby transfer the image-forming material from the recording medium to the stripping member. For this purpose, the thermoplastic resin component in the image-forming material should essentially have a glass transition temperature (Tg), melting temperature and viscoelastic properties within suitable ranges. The glass transition point is preferably from 40° C. to 100° C. and more preferably from 50° C. to 70° C. Within this range, the image-forming material can be fixed to and removed from the recording medium at relatively low temperatures and can be stored stably. The storage elastic modulus of the thermoplastic resin component is such that the temperature achieving a storage elastic modulus of 10,000 dyne/cm$^2$ at a measurement frequency of 20 Hz stands preferably at 80° C. or more, and more preferably at 90° C. to 160° C.

The image-forming material may further comprise any of known or conventional additives such as charge control agents, releasing agents and external additives. Examples of the charge control agents are nigrosine dyes, triphenylmethane dyes, molybdic acid chelate pigments, rhodamine dyes, alkoxy-based amines, quaternary ammonium salts, fluorine-containing surfactants, metal salts of salicylic acid and metal salts of salicylic acid derivatives.

The releasing agent is added in order to prevent adhesion (hot offset) of the image-forming material typically to an image-fixing roller or image-fixing belt upon image fixing with the use of the thermal image-fixing unit. Examples thereof are waxes having a melting temperature from 60° C. to 110° C., such as carnauba wax, montan wax, beeswax, paraffin wax and microcrystalline wax.

The external additive is added in order to improve the fluidity, developing properties and charge ability of the powdery image-forming material and is generally added so as to cover the surface of particle comprising the colorant and the resin component. Examples of the external additives are fine inorganic particles of silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, iron red, antimony trioxide, magnesium oxide, zirconium oxide, barium sulfate, barium carbonate, calcium carbonate, silicon carbide and silicon nitride. These fine inorganic particles preferably have a primary particle diameter of from 2 nm to 5 nm and more preferably from 5 nm to 500 nm. The amount of the fine inorganic particles in the powdery image-forming material is preferably from 0.01 to 5% by weight and more preferably from 0.01 to 2.0% by weight based on the total weight of the image-forming material.

The powdery image-forming material can be prepared from these materials according to a conventional preparation procedure such as kneading-pulverization, dispersion polymerization or suspension polymerization.

Examples of the device for forming an image with the use of the powdery thermoplastic image-forming material are a device in which an image of the powdery thermoplastic image-forming material is formed on a photoconductor and the powdery thermoplastic image-forming material is directly transferred from the photoconductor to a recording medium; a device in which the powdery image-forming material is once transferred from the photoconductor to an intermediate image transfer member and then transferred to the recording medium; a device in which an electrostatic latent image is written to an electrostatic recording member with the use of a needle electrode or ion stream, the latent image is developed with the powdery image-forming material and is then transferred from the electrostatic recording member to the recording medium; a toner jet device in which a toner is deposited on the recording medium while controlling the voltage applied to a grid to thereby control the movement of the toner; and a magnetic recording device, in which magnetic recording is carried out on a recording member comprising a magnetic material, and the resulting image is developed with a magnetic powder.

The image forming apparatus, the image erasing apparatus and the image forming-erasing system of the present invention will be illustrated in more detail with reference to concrete examples. FIG. 1 illustrates an example of the image forming-erasing system, in which an image forming apparatus for forming an image by electrophotography, and an image erasing apparatus 250 are housed in one casing. The image forming apparatus in FIG. 1 is an electrophotographic image forming apparatus, in which images are formed in the following manner. Yellow (Y), magenta (M), cyan (C) and black (K) images are formed on different photoconductors 201, respectively, the images formed in the different stations are transferred onto an intermediate image-transfer member 217. The transferred images on the intermediate image transfer member 217 is transferred onto a recording medium 237 which is conveyed from a recording medium storage casing 231. The images formed from powdery image-forming materials are fixed to the recording medium 237 by thermal image-fixing using an image-fixing roller 244. Such an electrophotographic color image forming apparatus is known as a tandem color electrophotographic apparatus.

The yellow (Y), magenta (M), cyan (C) and black (K) image-forming stations comprise the following known components for electrophotographic apparatuses. Specifically, the image-forming stations comprise, for example, photoconductors 201 [201Y, 201M, 201C and 201K], charging unit 202 [202Y, 202M, 202C and 202K] for uniformly charging the photoconductors 201, light irradiators (not shown), developers 203 [203Y, 203M, 203C, 203K], corona wire chargers 205 [205Y, 205M, 205C, 205K], units 206 [206Y, 206M, 206C, 206K] for applying an electric field, and cleaners 207 [207Y, 207M, 207C, 207K]. The photoconductors 201 are in the form of a drum or belt and each comprise a substrate typically made of a metal, and a photoconductor layer and/or protective layer arranged on the surface of the substrate. The charger 202 comprise, for example, a charger roller or a wire charger. The light irradiator serves to apply light to the uniformly charged photoconductors in accordance with images to be formed and comprises, for example, a laser system, an LED, luminophor-liquid crystal light valve, and an optical system for conventional analog copying machines, in which light is applied to a document on a document table and the resulting reflected light is fed to a photoconductor. The developers 203 each have, for example, a magnetic roller and/or toner conveying roller inside thereof and serve to develop latent electrostatic images formed by light irradiation with powdery toners to hereby form visible images. The corona wire chargers 205 serve to control the charge of the powdery images formed on the photoconductors 201. The means 206 are in the form of a roller or corona wire and serve to apply an electric field to thereby transfer the powdery images from the photoconductors 201 to an intermediate transfer belt. The cleaner 207 serve to remove powdery toners remained on the photoconductors 201 after image transfer. The image forming apparatus may further comprise any suitable known components according to necessity in addition to these components. Examples of such additional components are charge-eliminating means, such as an AC charger or a light irradiator, for eliminating the charge on the photoconductors 201 after image transfer; and a detecting unit for detecting the charge voltage applied to the photoconductors 201 in combination with a control unit for controlling the voltage applied to the chargers 202 so as to keep the surface potentials of the photoconductors 201 at constant level even in varying environmental conditions or in deterioration due to repetitive use. If toner removal from the photoconductors 201 after image transfer is not required, the cleaner 207 [207Y, 207M, 207C, 207K] can be omitted. Likewise, if there is no need of charging the powdery images formed on the photoconductors 201, the corona wire chargers 205 [205Y, 205M, 205C, 205K] can be omitted.

The intermediate image-transfer belt (member) 217 is arranged so that rollers 211, 212, 213 and 214 are in contact with the inner wall thereof. A mechanism for applying tension (not shown) applies a suitable tension to the intermediate image-transfer belt 217. The intermediate image-transfer belt 217 has a unit 210 for eliminating powder deposited on the surface of the belt, such as a brush or roller. Where necessary, the image forming apparatus further comprises charge eliminating means and/or charging the means for eliminating or uniformizing the charge remained on the intermediate image-transfer belt 217 after image transfer to the recording medium.

The recording medium on which an image is finally formed is housed in recording medium storage casings 231 [231*a* and 231*b*] and is fed to a paper conveying system by the action of paper feed rollers 232 [232*a* and 232*b*] and is conveyed via pairs of paper feed rollers 233 [233*a*, 233*b*, 233*c*, 233*d*, 233*e* and 233*f*] and 269. The powdery image is transferred from the intermediate image-transfer belt 217 to the recording medium by the action of unit 242 for applying an electric field, such as a voltage applying roller or a corona wire charger.

The image-forming material transferred to the recording medium is fixed thereto by the action of the image-fixing unit typically comprising a heat roller or heat belt 244 and a pressure roller 245. The recording medium bearing the fixed image is ejected via a pair of output rollers 241 to an output tray 240.

An image-erasable recording medium was prepared in the following manner.

Figure 2A:
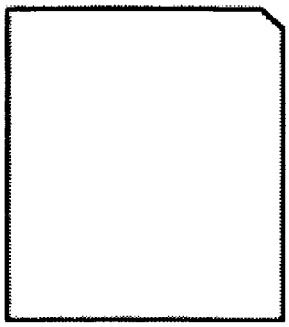
FIGS. 2A, 2B, 2C and 2D illustrate examples of recoding media for use in the present invention.
Figure 2B:
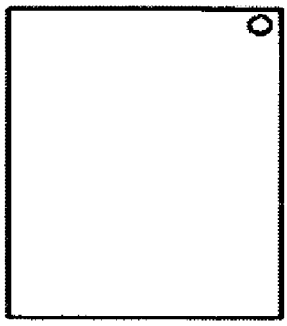
Figure 2C:
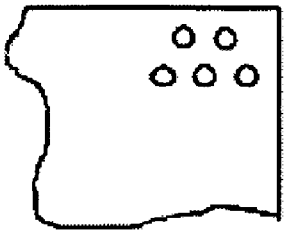
Figure 2D:
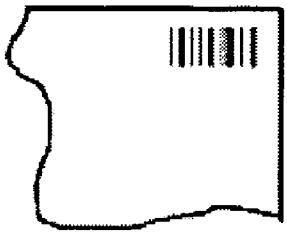

A mixture of 64 parts by weight of an aqueous solution of carboxymethylcellulose (CMC) (solid content: 5.0% by weight, a product of Daicel Chemical Industries, Ltd.), 4 parts by weight of an aqueous solution of a poly(vinyl alcohol) (solid content: 10% by weight, a product of Kuraray Co., Ltd.), 4 parts by weight of glyoxal (solid content: 40%) and 29 parts by weight of water was fully stirred to yield a coating composition. The coating composition was applied to both sides of paper having a basis weight of 75 g/m$^2$ to a weight on dry basis per each side of 4 g/m$^2$. The double-coated paper was dried and heated at 40° C. for 20 hours. A 5% by weight aqueous solution of a perfluoroalkylcarboxylic acid was applied to both sides of the resulting paper to a weight on dry basis per each side of 0.2 g/m$^2$ and was dried at 70° C. for about 10 seconds. The dried paper was subjected to supercalendering to yield a recording medium having a smoothness measured according to J. TAPPI No. 5-B method of 250 seconds. The recording medium was subjected to smoothing and cut into A-4 sized sheets. Notches as recording medium-identification information for indicating as being an image-erasable recording medium were formed in two corners in the sheet as shown in FIG. 5A to thereby yield an image-erasable recording medium. The notches, however, in this image-erasable recording medium were formed in two corners of one long side, in contrast to the recording medium shown in FIG. 5A. A hole as shown in FIG. 2B can be formed as the recording medium-identification information instead of, or in addition to, a notch as shown in FIG. 2A. In the case there is a possibility of confusing such an image-erasable recording medium having one hole with other recording media, a plurality of holes and/or notches can be formed (FIG. 2C). A mark such as bar code is also preferred to avoid confusion with other recording media.

Figure 3:
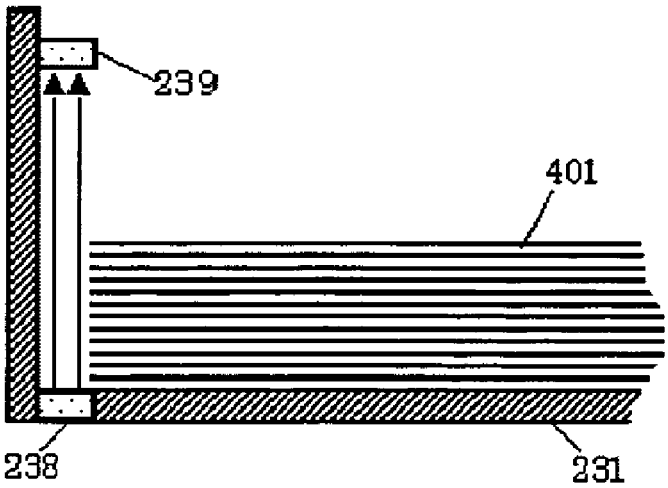
FIG. 3 is an enlarged view of the rear end of a recording medium storage casing 231 in the present invention, when viewed in a sheet feeding direction.

FIG. 3 is an enlarged view of the tail of the recording medium storage casing 231 when viewed from the feed direction. A light-emitting device 238 and a light-receiving device 239 are arranged in the vicinity of a side edge at the tail of the recording medium storage casing 231 and serve to detect whether or not the recording medium has at least one of notches and holes. The light-receiving device 239 receives light and transmit a signal to a control unit (not shown) for determining the presence or absence of an image-erasable recording medium. In this control unit, the limit was set such that the control unit does not determine that image formation on an image-erasable recording medium can be carried out unless all the recording media housed in the recording medium storage casing are image-erasable recording media. In other words, even if only one regular recording medium other than image-erasable recording medium is housed in the storage casing, the control unit does not determine that image formation on an image-erasable recording medium can be carried out. The image forming apparatus exemplified in FIG. 1 has two recording medium storage casings 231*a* and 231*b*, of which the recording medium storage casing 231*b* serves to house an image-erasable recording medium. The number of the recording medium storage casing can be suitably set, for example, so as to house recording media of different sizes or to house sheets of a recording medium in different feed direction (longitudinal feed direction and transverse feed direction).

The user can select an image-forming mode from the first image-forming mode and the second image-forming mode arbitrarily, for example, at a control panel (not shown) of the image forming apparatus or at a user interface shown in a display connected to a computer which is connected to an image forming apparatus as shown in FIG. 1. In the control panel or the use interface, the first image-forming mode may be indicated, for example, as a button or a selection choice marked as "Reuse", "Paper Reuse", "Reuse Mode", "Dedicated Paper", "Reusable Paper", "Resource Saving", "Short-term Perusal" or "Short-term Use". The second image-forming mode may be indicated, for example, as a button or a selection choice marked as "Image-fixing Mode", "High Image-fixing", "Fix Mode", "Plain Paper", "Unused Paper", "Document Storage" or "External Distribution". The selection of the image-forming mode can also be set, for example, so that a higher priority is given to the first image-forming mode, the first image-forming mode is automatically selected unless the user takes an action, and the user takes an action to select the second image-forming mode only in the case where the user wants to form an image according to the second image-forming mode. In this case, the image forming-erasing system preferably further comprises a unit for select the mode having a higher priority and being automatically selected unless the user takes an action from the first image-forming mode and the second image-forming mode. This enables the user to change the priority mode depending on varying conditions and to automatically select a mode frequently employed without a selection operation.

Upon manual or automatic selection of the first image-forming mode by the user, the control unit of the image forming apparatus determines the presence or absence of an image-erasable recording medium and whether or not a printing mode, such as duplex printing, in which image formation according to the first image-forming mode is prohibited, is selected. Use of a stapler or opening of holes for filing often inhibit reuse of the recording medium. When such a stapler or devise for forming holes for filing is connected to and controlled by the image forming apparatus, the control unit of the image forming apparatus is preferably so configured as to prohibit the use of the stapler or the devise for forming holes for filing upon image formation according to the first image-forming mode. When the use of the stapler or the devise for forming holes for filing is prohibited, the control unit permits the image-forming unit to carry out image formation according to the first image-forming mode. The image forming apparatus preferably further comprises a control unit and/or display for feeding back information indicating that no image-erasable recording medium is housed in the storage casing to the control panel or the user interface when no image-forming mode is detected in the storage casing. This information should be indicated at the time when the first image-forming mode is manually or automatically selected, and a target size of the recording medium is selected by the user. Likewise, the image forming apparatus preferably further comprises control unit and/or display which serves to feed back information on the prohibition of combination of procedures to the control panel or the user interface at the time when the first image-forming mode is selected together with, for example, duplex image formation, stapling or forming of holes for filing.

The control unit of the image forming apparatus controls to select and feed an image-erasable recording medium of the desired size automatically when plural recording medium storage casings are arranged in the image forming apparatus. This operation is done when a printing command is made by the push of a start button or printing button in the control panel or the click of an OK button in the user interface after manual or automatic selection of the first image-forming mode. The image forming apparatus shown in FIG. 1 includes reflective light-emitting and light-receiving devices 271 for detecting and confirming whether or not the conveyed recording medium from the recording medium storage casing is an image-erasable recording medium. The light-emitting and light-receiving devices 271 are not essential, since the image forming apparatus has the detecting unit for detecting whether or not a recording medium housed in the storage casing is an image-erasable recording medium. These devices are arranged as a fail-safe system for avoiding image formation on a regular recording medium other than image-erasable recording media, even when there is an error in the detection of the detecting unit in the storage casing. The control unit controls the image forming apparatus in the following manner. When no recording medium-identification information, such as a notch or hole, for indicating as being an image-erasable recording medium is detected on the fed recording medium, the image forming operation of the image-forming unit is stopped, and the fed recording medium is ejected to an output tray without image formation. When a printing command for forming images on plural sheets of recording medium is made and no recording medium-identification information is detected on the fed recording medium, feeding of a successive sheet of the recording medium is prohibited, and an indication that an image-inerasable recording medium is detected is shown in the control panel or the user interface.

Figure 4:
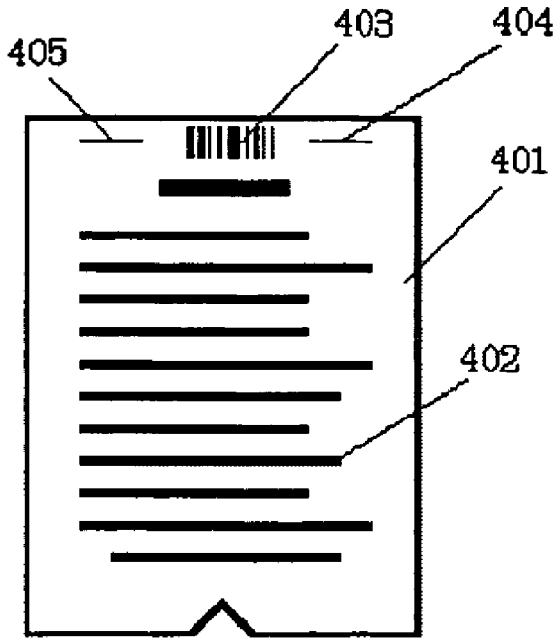
FIG. 4 illustrates another example of the recording media for use in the present invention.

A mode-identification mark for indicating as image formation according to the first image-forming mode is formed on the recording medium upon image formation after manual or automatic selection of the first image-forming mode. The mode-identification mark, for example, is a bar code 403 shown in FIG. 4 and is printed according to a process for forming an erasable image as in other image information 402. When the image forming apparatus employs, for example, an electrophotographic image forming method, light emission of laser or LED, or opening/closing of a shutter element such as a liquid crystal is controlled by a unit for generating an identification pattern signal thereby form a latent electrostatic image of the identification pattern on a photoconductor. The latent electrostatic image is then developed in a developer to form a visible identification pattern.

In a color image forming apparatus as shown in FIG. 1, the mode-identification mark is not necessarily formed as a multi-color image, but must be formed as an image which the image erasing apparatus can read. A mode-identification mark formed as a multi-color image may be difficult to be read by the image erasing apparatus due to, for example, color drift. Thus, the mode-identification mark is preferably formed as, for example, a black identification pattern. This pattern does not invite color drift, has a high contrast and is easily read by the image erasing apparatus.

The mode-identification mark may be formed as an image invisible by naked eyes, typically using an image-forming material containing a fluorescent dye or pigment, an ultraviolet-absorbing dye or pigment, or an infrared-absorbing dye or pigment. However, the mode-identification mark is generally preferably formed as a visible image, since such a visible image can be read by not only the image erasing apparatus but also the user to distinguish the image as being formed according to the first image-forming mode. When the mode-identification mark is not indicated in a language, as the bar code 403 on the recording medium 401 of FIG. 4, the image forming apparatus preferably further comprises means for printing a language message at a position 404 or 405 in FIG. 4. Examples of the message are "Printed in a reuse mode", "Printed in a short-term use mode", "Erase the image after use" and "Printed in an eco-friendly printing mode". Such a language message can be recognized by the user more easily.

The image forming process can be changed in image formation according to the first image-forming mode so that the resulting image can be erased more easily than one formed according to the second image-forming mode. The image forming process can be charged, for example, by changing the image-fixing conditions, or by arranging means for forming a halftone image at two-level or at multi-level and carrying out binary halftone image formation in the first image-forming mode, as is described above. The thermal image-fixing unit of the image forming apparatus shown in FIG. 1 can set the image-fixing temperature in the first image-forming mode than the second image-forming mode. In this case, the image forming apparatus may further comprise a control unit for setting the speed of the recording medium passing through the image-fixing device in the first image-forming mode higher than in the second image-forming mode in the case where the temperature of the image-fixing device is not sufficiently decreased. This may occur when a printing command is made immediately after the image forming mode is changed from the second mode to the first mode.

An area surrounded by a dotted line 250 in FIG. 1 is the image erasing apparatus. The image erasing apparatus comprises, for example, a recording medium storage casing 251, paper feed rollers 252, an aluminium block 253, a tension roller 255, a belt-shaped stripping member 257, a pressure roller 256, a spiral cleaning blade 258, a casing 259, a pair of conveying rollers 281 and 282, a detecting unit 264, a storage casing 261, a guide plate 262, a movable guide plate 267, and a pair of output rollers 263. The storage casing 251 serves to house a recording medium to be subjected to image erasing. The paper feed rollers 252 serve to deliver the recording medium to the image erasing unit. The aluminum block 253 includes a halogen lamp 254 as a heat source. The belt-shaped striping member 257 is span around the aluminum block 253, a tension roller 255 and a cleaning backup roller 265 and is made from a metal such as nickel or stainless steel, or a polymeric compound such as poly (ethylene terephthalate), polyimide, aramid, poly(ethylene naphthalate) or poly(ether ether ketone). The pressure roller 256 is made typically from stainless steel, aluminum or iron, has an elastic member on its surface and serves to pressurize the conveyed and heated recording medium and the stripping member 257. Examples of a material for the elastic member are silicone rubber, fluorocarbon rubber and polyurethane rubber. The cleaning blade 258 serves to eliminate the image-forming material from the stripping member 257, which image-forming material has been transferred from the recording medium. The casing 259 serves to store the image-forming material eliminated from the stripping member 257. The pair of conveying rollers 281 and 282 serves to convey the recording medium after image erasing to the recording medium storage casing 231 of the image forming apparatus. The detecting unit 264 serves to detect the presence or absence of the mode-identification mark for indicating an image as being formed according to the first image-forming mode in the image forming apparatus. The storage casing 261 serves to house a recording medium from which the image is not erased. The guide plate 262 and the movable guide plate 267 serve to guide the recording medium to the storage casing 261.

The recording medium to be subjected to image erasing is housed in the recording medium storage casing 251. The recording medium storage casing 251 herein has a pair of a light-emitting device, light-receiving device for detecting the recording medium-identification information, such as notches, as in the recording medium storage casing 231 of the image forming apparatus. When the recording medium has notches as the recording medium-identification information in two corners, sheets of the recording medium are aligned and set in the storage casing 251 so that the notches stand at the tail of the sheets. The image erasing apparatus herein also comprises a control unit for displaying a message of "Paper from which the toner cannot be eliminated is housed in the storage casing" in the control panel unless the detecting unit detects that all the recording media housed in the recording medium storage casing 251 have the recording medium-identification information such as notches. The housed recording medium is delivered to the image erasing unit (image-erasing means) by the action of the feed rollers 252. The detecting unit 264 for detecting the presence or absence of the mode-identification mark is, for example, an image sensor comprising a line sensor or CCD and capable of reading an image pattern. The detecting unit 264 serves to a mode-identification mark, for example, at the center part of the tip of the fed recording medium, compare the read pattern with an identification pattern recorded in a memory of the control unit and decide to allow or prohibit an image erasing operation.

A recording medium which has been identified as having the mode-identification mark is conveyed into between the belt-shaped stripping member 257 and the pressure roller 256 while being guided by the movable guide plate 267. The belt-shaped stripping member 257 is heated by the halogen lamp 254 in the aluminum block 253. The surface temperature of the aluminum block 253 is detected by temperature detecting unit (not shown) such as a thermistor, a thermocouple, a platinum resistance thermometer or a thermal radiation measuring instrument. The detected surface temperature is inputted into a temperature control unit (not shown). The temperature control unit compares the inputted surface temperature with a predetermined temperature and controls the operation of unit (not shown) for changing the power supply to the halogen lamp 254 to thereby maintain the surface temperature at constant. The surface temperature is generally set at about 50° C. to about 200° C., and preferably at about 80° C. to about 120° C. for eliminating or erasing an image formed from a regular electrophotographic toner.

The image-forming material on the recording medium is heated by the action of contact with the heated belt-shaped stripping member 257. Pressure unit (not shown) serves to apply a pressure between the belt-shaped stripping member 257 and the pressure roller 256 typically by the action of a spring, hydraulic pressure or air pressure. Thus, the recording medium bearing the image-forming material on its surface and the stripping member 257 are pressurized so that the image-forming material is in contact with the stripping member 257. The image-forming material on the recording medium is attached to the stripping member 257 by the action of heat and pressure.

An edge of the aluminum block 253 downstream from the pressure roller 256 has a curvature of about 1 to 5 mm in terms of radius. The belt-shaped stripping member 257 is conveyed along this curve and is separated from the recording medium due to the rigidity of the recording medium.

The image-erasable recording medium is so configured as to have an adhering force to the image-forming material weaker than that of the stripping member 257. Once the recording medium is separated from the stripping member 257, the image-forming material is transferred from the recording medium to the surface of the stripping member 257. Thus, the image-forming material is eliminated or erased from the recording medium.

The image-forming material transferred from recording medium to the stripping member 257 is then scraped off by the rotating spiral cleaning blade 258 and is stored in the image-forming material storage casing 259. The recording medium after image erasing is ejected into the recording medium storage casing 231*b* of the image forming apparatus by the action of the pair of conveying rollers 281 and 282. By the action of a hoisting and lowering mechanism (not shown), the feed roller 232*a* of the image forming apparatus ascends and stands at such a position as not to inhibit the storage of the recording medium into the recording medium storage casing 231*b*, when the recording medium after image erasing is ejected from the image erasing apparatus. The feed roller 232*a* descends and rotates to an opposite direction to the feed direction of the recording medium upon image formation at the time when no more recording medium is conveyed by the pair of conveying rollers 282. Thus, sheets of the recording medium ejected from the image erasing apparatus are fully stored in the recording medium storage casing 231*b*.

When the detecting unit 264 determines that the recording medium in question has no mode-identification mark based on the signal inputted into the detecting unit 264, the movable guide plate 267 is rotated by rotating unit (not shown) and guides the recording medium toward the guide plate 262 for guiding the recording medium to the storage casing 261. The recording medium identified as having no mode-identification mark is conveyed to the pair of output rollers 263 while guided by the movable guide plate 267 and is ejected to the storage casing 261 by the action of the pair of output rollers 263.

The image forming-erasing system according to this embodiment is configured as follows. The recording medium is housed in the recording medium storage casing so as to convey the recording medium in the widthwise direction both in the image forming apparatus and the image erasing apparatus. The image forming apparatus prohibits conveying of the recording medium in a lengthwise direction upon image formation according to the first image-forming mode. Specifically, image formation according to the first image-forming mode is prohibited when the side fence of the recording medium storage casing 232*b* in the image forming apparatus is set at such a position as to feed the recording medium in the lengthwise direction. Likewise, the image erasing apparatus is so configured as to house only recording medium storage casings that can house the recording medium in the transverse feed direction.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

an image forming unit configured to selectively operate in a first image-forming mode for forming an erasable image and in a second image-forming mode for forming an inerasable image;

a detecting unit configured to detect recording-medium identification information that is provided on an image-erasable recording medium for identifying the image-erasable recording medium from a medium other than the image-erasable recording medium;

a mode-control unit configured to prohibit formation of an erasable image in the first image-forming mode by said image forming unit, unless the detecting unit detects recording-medium identification information; and an information control unit configured to control said image forming unit to form mode-identification information on a recording medium during image formation in the first image-forming mode for identifying the image as being formed according to the first image-forming mode, wherein said image forming unit is configured to form the mode-identification information with an image-forming material that is identical to an image-forming material used to form images other than the mode-identification information on the recording medium.

2. An image forming apparatus according to claim 1, wherein the mode-identification information is an image-wise mark.

3. An image forming apparatus according to claim 1, further comprising:

one or more housing units capable of housing the image-erasable recording medium and the medium other than the image-erasable recording medium, respectively, wherein the detecting unit is arranged in the housing unit so as to detect whether or not a recording medium housed in the housing unit is the image-erasable recording medium, and wherein the mode-control unit determines that image formation on an image-erasable recording medium can be carried out, provided that the first image-forming mode is selected and that the detecting unit detects the image-erasable recording medium being housed in the housing unit.

4. An image forming apparatus according to claim 1, wherein said mode-control unit is configured to prohibit image formation on the image-erasable recording medium when the second image-forming mode is selected.

5. An image forming apparatus according to claim 1, wherein said information control unit is configured to control said image forming unit to not form the mode-identification information on to a recording medium during image formation in the second image-forming mode.

6. An image forming apparatus according to claim 1, further comprising:

one or more housing units capable of housing the image-erasable recording medium and the medium other than the image-erasable recording medium, respectively, wherein the recording medium-identification information is notches or holes formed on the recording medium, and wherein the detecting unit is arranged in at least part of the housing unit and is configured to detect whether or not all the recording media housed in the housing unit each have notches or holes.

7. An image forming apparatus according to claim 1, wherein the image-forming unit is configured to fix the image-forming material onto the recording medium according to thermal image-fixing or flash fixing, and wherein the image forming apparatus further comprises a process-control unit for setting an image fixing process so adhesion of the fixed image to the recording medium is weaker in the first image-forming mode than in the second image forming mode by the action of at least one selected from the group consisting of a lower image-fixing temperature, a lower image-fixing pressure, a smaller quantity of light, a shorter image-fixing process pass and a higher image-fixing speed.

8. An image forming apparatus according to claim 1, wherein said image forming unit is so configured to form an image on both sides of the recording medium, and wherein said mode-control unit is configured to prohibit image formation on both sides of the recording medium when the first image-forming mode is selected.

9. An image forming apparatus comprising:

an image forming unit configured to selectively operate in a first image-forming mode for forming an erasable image and in a second image-forming mode for forming an inerasable image;

a detecting unit configured to detect recording-medium identification information that is provided on an image-erasable recording medium for identifying the image-erasable recording medium from a recording medium other than the image-erasable recording medium; and a mode-control unit configured to prohibit formation of an erasable image in the first image-forming mode by said image forming unit, unless the detecting unit detects recording-medium identification information, wherein the image forming unit is configured to form an image onto a recording medium both according to a binary image-forming mode and a multi-level image-forming mode, and wherein said mode-control unit is configured to prohibit the multi-level image-forming mode and to allow image formation according to the binary image-forming mode when the first image-forming mode is selected.

10. An image erasing apparatus comprising:

an image erasing unit for erasing an image on a recording medium;

a detecting unit for detecting mode-identification information, the mode-identification information being formed on a recording medium by the action of an image forming apparatus and identifying an image as being formed according to a first image-forming mode for forming an erasable image; and a control unit being so configured as to prohibit the image erasing unit from carrying out an image-erasing operation on a recording medium unless the mode-identification information is detected on the recording medium.

11. An image erasing apparatus according to claim 10, wherein the control unit is so configured as to prohibit the image erasing unit from carrying out an image-erasing operation on a recording medium unless the mode-identification information is detected on the recording medium, even when the recording medium has a recording medium-identification information for identifying that an image formed thereon can be erased.

12. An image erasing apparatus according to claim 10, wherein the image erasing unit comprises:

a heater configured to heat an image-forming material on the recording medium;

a stripping member;

a pressurizer configured to press the striping member against the heated image-forming material on the recording medium; and a detacher configured to detach the stripping member from the recording medium.

13. An image forming-erasing system comprising:

an image forming apparatus including an image forming unit configured to selectively operate in a first image-forming mode for forming an erasable image and in a second image-forming mode for forming an inerasable image, a detecting unit configured to detect recording-medium identification information that is provided on an image-erasable recording medium for identifying the image-erasable recording medium from a medium other than the image-erasable recording medium, and a mode-control unit configured to prohibit formation of an erasable image in the first image-forming mode by said image forming unit, unless the detecting unit detects recording-medium identification information, wherein said image forming unit is configured to form mode-identification information for identifying an image as being formed according to the first image-forming mode when image formation is carried out in the first image-forming mode; and an image erasing apparatus including an image erasing unit for erasing an image on a recording medium, a detecting unit for detecting the mode-identification information, and a control unit being so configured as to prohibit the image erasing unit from carrying out an image-erasing operation on a recording medium unless the mode-identification information is detected on the recording medium.

14. An image forming-erasing system according to claim 13, wherein the image forming apparatus comprising:

a control unit for allowing the image-forming unit to convey a recording medium only in one direction selected from the lengthwise direction and the widthwise direction of the recording medium upon image formation according to the first image-forming mode, and wherein the image erasing unit is so configured as to be able to convey the recording medium in one direction selected from the lengthwise direction and the widthwise direction, or the image erasing apparatus comprises a control unit for allowing the image erasing unit to carry out an image erasing operation only when the recording medium is conveyed in one direction selected from the lengthwise direction and the widthwise direction.

15. An image forming-erasing system according to claim 14, wherein the control unit in the image forming apparatus allows the image-forming unit to convey the recording medium only in a widthwise direction of the recording medium upon image formation according to the first image-forming mode, and wherein the image erasing unit is so configured as to be able to carry out an image-erasing operation only when the recording medium is conveyed in a lengthwise direction of the recording medium, or the image erasing apparatus comprises a control unit for allowing the image erasing unit to carry out an image erasing operation only when the recording medium is conveyed in a lengthwise direction.

16. An image forming-erasing system according to claim 14, wherein the information-imparting unit of the image forming apparatus is so configured as to impart an image-wise mark to the recording medium upon image formation according to the first image-forming mode, the mark serving as the mode-identification information and being formed with an image-forming material.

17. An image forming-erasing system according to claim 13, wherein the image-forming unit is capable of conveying a recording medium in any of a lengthwise direction and a widthwise direction and capable of forming an image on the conveyed recording medium, wherein the image forming apparatus comprises:

a control unit for allowing the image-forming unit to convey the recording medium only in one direction selected from the lengthwise direction and the widthwise direction upon image formation according to the first image-forming mode, and wherein the image erasing unit of the image erasing apparatus is so configured as to be able to convey the recording medium only in the same direction as the conveying direction of the recording medium in image formation according to the first image-forming mode in the image forming apparatus, or the image erasing apparatus comprises a control unit for allowing the image erasing unit to convey the recording medium only in the same direction as the conveying direction of the recording medium in image formation according to the first image-forming mode in the image forming apparatus.

18. An image forming-erasing system according to claim 13, wherein the image-forming unit is capable of conveying a recording medium in any of a lengthwise direction and a widthwise direction and capable of forming an image on the conveyed recording medium, wherein the image forming apparatus comprises:

a control unit for controlling the information-imparting unit to impart the mode-identification information to the recording medium when the first image-forming mode is selected and an image is formed, the portion where the mode-identification mark is formed positioning at a tip or in the vicinity of the tip of the recording medium in any of the cases where the recording medium is conveyed in the lengthwise direction and where the recording medium is conveyed in the widthwise direction, and wherein the image erasing unit of the image erasing apparatus is so configured as to convey the recording medium only in one direction selected from the lengthwise direction and the widthwise direction and to carry out an image erasing operation.

* * * * *